US010207847B2

(12) United States Patent
Hollis et al.

(10) Patent No.: US 10,207,847 B2
(45) Date of Patent: Feb. 19, 2019

(54) MULTIPLE USER LOCKOUT SYSTEMS

(71) Applicant: Master Lock Company LLC, Oak Creek, WI (US)

(72) Inventors: Robert Hollis, Waukesha, WI (US); Trey Roeser, Oak Creek, WI (US)

(73) Assignee: MASTER LOCK COMPANY LLC, Oak Creek, WI (US)

( * ) Notice: Subject to any disclaimer, the term of this patent is extended or adjusted under 35 U.S.C. 154(b) by 126 days.

(21) Appl. No.: 15/335,696

(22) Filed: Oct. 27, 2016

(65) Prior Publication Data

US 2017/0113856 A1 Apr. 27, 2017

Related U.S. Application Data

(60) Provisional application No. 62/246,902, filed on Oct. 27, 2015, provisional application No. 62/318,332, filed on Apr. 5, 2016.

(51) Int. Cl.
*B65D 55/14* (2006.01)
*B65D 43/16* (2006.01)
(Continued)

(52) U.S. Cl.
CPC ..... *B65D 55/14* (2013.01); *B65D 43/165* (2013.01); *B65D 43/20* (2013.01); *B65D 43/22* (2013.01);
(Continued)

(58) Field of Classification Search
CPC ..... B65D 55/14; B65D 43/20; B65D 43/165; B65D 43/22; E05F 1/16; E05F 7/02;
(Continued)

(56) References Cited

U.S. PATENT DOCUMENTS 282,019 A 7/1883 Williams
1,377,413 A 5/1921 Dwelle
(Continued)

FOREIGN PATENT DOCUMENTS

CH 674395 5/1990
EP 0429813 A1 6/1991
(Continued)

OTHER PUBLICATIONS

International Search Report and Written Opinion for International Application No. PCT/US2016/59008 dated Mar. 16, 2017.
(Continued)

*Primary Examiner* — James N Smalley
(74) *Attorney, Agent, or Firm* — Calfee, Halter & Griswold LLP

(57) ABSTRACT

A lockable enclosure includes a housing and an access door. The access door includes a hinge portion connected with a first side wall of the housing and is pivotable about the hinge portion between closed and open positions. When the access door is in the closed position, the hinge portion of the access door is slideable for sliding movement of the access door between a latching position in which a first latch portion of the access door engages a corresponding second latch portion of the housing to secure the access door in the closed position, and a release position in which the first interlock portion disengages from the second interlock portion to permit pivoting movement of the access door from the closed position to the open position. The access door further comprises at least one locking feature configured to secure the closed access door in the latching position.

20 Claims, 41 Drawing Sheets

(51) Int. Cl.

| | |
|---|---|
| ***B65D 43/20*** | (2006.01) |
| ***B65D 43/22*** | (2006.01) |
| ***E05B 19/00*** | (2006.01) |
| ***E05B 65/00*** | (2006.01) |
| ***E05B 67/38*** | (2006.01) |
| ***E05C 19/10*** | (2006.01) |
| ***E05D 7/00*** | (2006.01) |
| ***E05D 15/48*** | (2006.01) |
| ***E05F 1/16*** | (2006.01) |
| ***E05G 1/00*** | (2006.01) |
| ***E05G 1/024*** | (2006.01) |
| ***E05G 1/026*** | (2006.01) |
| ***E05D 7/14*** | (2006.01) |
| *E05D 3/02* | (2006.01) |
| *E05F 7/02* | (2006.01) |
| *E05C 19/14* | (2006.01) |

(52) U.S. Cl.

CPC ..... *E05B 19/0005* (2013.01); *E05B 65/0075* (2013.01); *E05B 67/383* (2013.01); *E05C 19/10* (2013.01); *E05D 7/009* (2013.01); *E05D 7/14* (2013.01); *E05D 15/48* (2013.01); *E05F 1/16* (2013.01); *E05G 1/005* (2013.01); *E05G 1/024* (2013.01); *E05G 1/026* (2013.01); *E05C 19/14* (2013.01); *E05D 3/022* (2013.01); *E05D 2015/485* (2013.01); *E05F 7/02* (2013.01); *E05Y 2201/22* (2013.01); *E05Y 2900/21* (2013.01)

(58) Field of Classification Search

CPC ..... E05G 1/026; E05G 1/024; E05G 1/005; E05B 67/383; E05B 19/0005; E05B 65/0075; E05D 7/14; E05D 7/009; E05D 15/48; E05D 2015/485; E05D 3/022; E05C 19/10; E05Y 2900/21

USPC ..... 220/210, 811–813, 345.1–345.6

See application file for complete search history.

(56) References Cited

U.S. PATENT DOCUMENTS

| | | | | |
|---|---|---|---|---|
| 1,719,129 | A | 7/1929 | Miles | |
| 1,877,910 | A | 9/1932 | Enfant | |
| 1,877,912 | A | 9/1932 | L'Enfant | |
| 1,923,787 | A | 8/1933 | Larsen | |
| 1,937,743 | A | 12/1933 | Brooks | |
| 1,948,255 | A | 2/1934 | Brooks | |
| 1,999,718 | A | 4/1935 | Brooks | |
| 2,219,561 | A | 10/1940 | Miller | |
| 2,479,592 | A * | 8/1949 | Tomezak | A45C 11/00 220/351 |
| 2,485,051 | A | 10/1949 | Joslia | |
| 2,635,665 | A | 4/1953 | Ashley | |
| 2,704,101 | A | 3/1955 | Wittrien | |
| 2,859,789 | A | 11/1958 | Buckett | |
| 2,875,803 | A | 3/1959 | Greene et al. | |
| 2,889,050 | A | 6/1959 | Modrey | |
| 3,318,354 | A | 5/1967 | Borisof | |
| 3,372,952 | A | 3/1968 | Newton | |
| 3,415,300 | A | 12/1968 | Worcester | |
| 3,563,293 | A | 2/1971 | Fisher | |
| 3,568,482 | A | 3/1971 | Shears | |
| 3,606,777 | A | 9/1971 | Watson | |
| 3,716,091 | A | 2/1973 | Gaines | |
| 3,926,234 | A | 12/1975 | Dean | |
| 3,933,017 | A | 1/1976 | Shee | |
| 4,072,033 | A | 2/1978 | Eckerdt | |
| 4,084,865 | A * | 4/1978 | Joyce | A45C 11/00 206/387.11 |
| 4,286,641 | A | 9/1981 | Watson | |
| 4,306,433 | A | 12/1981 | Kelly | |
| 4,331,194 | A | 5/1982 | Lederer | |
| 4,437,692 | A | 3/1984 | Halopoff | |
| D275,055 | S | 8/1984 | Davis | |
| 4,523,692 | A | 6/1985 | Lemkin | |
| 4,653,785 | A | 3/1987 | Tobey | |
| 4,655,487 | A | 4/1987 | Korn et al. | |
| 4,796,750 | A | 1/1989 | Ingham | |
| 4,799,587 | A | 1/1989 | Desanto | |
| 4,864,834 | A | 9/1989 | Waite | |
| 4,901,549 | A | 2/1990 | Dengel | |
| 4,911,486 | A | 3/1990 | Anderson | |
| 5,020,342 | A | 6/1991 | Doan et al. | |
| 5,046,343 | A | 9/1991 | Miwa | |
| 5,076,531 | A | 12/1991 | Delaney | |
| 5,123,579 | A | 6/1992 | Suglyama | |
| 5,191,974 | A | 3/1993 | Saalman | |
| 5,365,757 | A | 11/1994 | Primeau | |
| 5,524,462 | A | 6/1996 | Loughlin | |
| 5,544,505 | A | 8/1996 | McIntosh et al. | |
| 5,641,065 | A | 6/1997 | Owens et al. | |
| 5,653,332 | A | 8/1997 | Dewitt, Jr. | |
| 5,738,020 | A | 4/1998 | Correia | |
| 5,799,774 | A | 9/1998 | Dengel | |
| 5,829,580 | A | 11/1998 | Schroeder | |
| 5,905,244 | A | 5/1999 | Smith et al. | |
| 6,036,240 | A | 3/2000 | Hamilton et al. | |
| 6,047,573 | A | 4/2000 | Martinez | |
| D427,901 | S | 7/2000 | Lentini | |
| 6,085,671 | A | 7/2000 | Kerr et al. | |
| 6,148,993 | A | 11/2000 | Chisolm et al. | |
| 6,164,097 | A | 12/2000 | McBryde | |
| 6,176,109 | B1 | 1/2001 | Tsai | |
| 6,247,609 | B1 | 6/2001 | Gabele et al. | |
| 6,327,878 | B1 | 12/2001 | Levenson | |
| 6,708,532 | B2 | 3/2004 | Winland | |
| 7,118,144 | B2 | 10/2006 | Anderson | |
| 7,360,380 | B2 | 4/2008 | Van Handel | |
| 7,370,892 | B2 | 5/2008 | Collingham | |
| 8,408,609 | B2 | 4/2013 | Brojanac | |
| 2002/0108410 | A1 | 8/2002 | Webb et al. | |
| 2005/0199628 | A1 | 9/2005 | Van Handel et al. | |
| 2006/0162403 | A1 | 7/2006 | Handel | |
| 2010/0147853 | A1 | 6/2010 | Hackett | |

FOREIGN PATENT DOCUMENTS

| | | |
|---|---|---|
| FR | 2773539 | 7/1999 |
| GB | 2123386 A | 2/1984 |

OTHER PUBLICATIONS

International Search Report and Written Opinion of the International Search Authority from PCT/US2005/039418, dated Dec. 20, 2006.

International Search Report and Written Opinion for International Application No. PCT/US2009/044628, dated Jul. 9, 2009.

International Search Report from PCT/US2005/008409 dated Jun. 27, 2005.

Partial International Search Report for International Application No. PCT/US2016/59008 dated Jan. 23, 2017.

* cited by examiner

MULTIPLE USER LOCKOUT SYSTEMS

CROSS-REFERENCE TO RELATED APPLICATIONS

This application claims priority to and all benefit of U.S. Provisional Patent Application Ser. No. 62/246,902, filed on Oct. 27, 2015, for MULTIPLE USER LOCKBOX, and U.S. Provisional Patent Application Ser. No. 62/318,332, filed on Apr. 5, 2016, for MULTIPLE USER LOCKING ENCLOSURE AND DOCUMENT DISPLAY, the entire disclosures of both of which are fully incorporated herein by reference.

BACKGROUND

Many safety lockout devices are provided for restricting access to equipment and control instruments, including, for example, electrical components, such as switches, dials and push buttons, and fluid system components, such as valves and pressure regulators. Industrial and commercial equipment are often provided with or assembled with a key-operated lockout mechanism (e.g., a locking bracket and padlock or similar structure) to facilitate the restriction of access to or operation of the equipment.

In some applications, the authorization of multiple technicians or other authorized personnel is required to allow access to, or operation of, a locked out system or piece of equipment, for example, to comply with established safety procedures. In such an application, the use of multiple keys controlled by multiple users may be required to unlock the one or more lockout mechanisms to place the equipment in an operable condition.

SUMMARY

According to an exemplary embodiment of the present application, a lockable enclosure includes a housing and an access door. The housing includes first, second, third, and fourth side walls each extending forward from a rear wall to a front end to define a storage cavity therebetween. The access door includes a hinge portion connected with the first side wall, the access door being pivotable about a longitudinal axis of the hinge portion between a closed position blocking access to the cavity and an open position permitting access to the cavity. When the access door is in the closed position, the hinge portion of the access door is slideable for sliding movement of the access door between a latching position in which a first latch portion of the access door engages a corresponding second latch portion of the housing to secure the access door in the closed position, and a release position in which the first interlock portion disengages from the second interlock portion to permit pivoting movement of the access door from the closed position to the open position. The access door further comprises at least one locking feature configured to secure the closed access door in the latching position when the at least one locking feature is in a locked condition and to permit sliding movement of the closed access door to the release position when the at least one locking feature is in an unlocked condition.

According to another exemplary embodiment of the present application, a lockbox includes a body including front, rear, and first and second side body walls each extending upward from a bottom body wall to an upper edge to define a storage enclosure therebetween, and a first body flange extending laterally outward from a bottom end of the upper portion of the first body side wall, and a lid connected to the body and pivotable between a closed position blocking access to the enclosure and an open position permitting access to the enclosure. The lid includes front and first and second side lid walls extending downward from a top lid wall to a lower edge to overhang upper portions of the front and first and second side body walls when the lid is in the closed position, and a first lid flange extending laterally outward from the lower edge of the first lid side wall. When the lid is in the closed position, a first lid lock aperture in the first lid flange aligns with a first body lock aperture in the first body flange, such that insertion of a padlock shackle through the first lid lock aperture and the first body lock aperture prevents movement of the lid with respect to the body.

According to another exemplary embodiment of the present application, a lockbox includes a body having front, rear, and first and second side body walls each extending upward from a bottom body wall to an upper edge to define a storage enclosure therebetween, and a lid connected to the body and pivotable between a closed position blocking access to the enclosure and an open position permitting access to the enclosure. The lid includes front and first and second side lid walls extending downward from a top lid wall to a lower edge to overhang upper portions of the front and first and second side body walls when the lid is in the closed position. When the lid is in the closed position, the lid is slideable between a latched position in which the lid is secured against pivoting movement to the open position and an unlatched position in which the lid is permitted to pivot to the open position. When the lid is in the latched position, a first lid lock aperture in the lid aligns with a first body lock aperture in the body, such that insertion of a padlock shackle through the first lid lock aperture and the first body lock aperture prevents sliding movement of the lid from the latched position to the unlatched position. The lid is pivotably connected to the body by first and second pivot pins slideable in first and second side slots to permit sliding movement of the lid between the latched and unlatched positions.

According to another exemplary embodiment of the present application, a safety lockout system includes at least one lockbox and at least one padlock. The at least one lockbox includes a body defining a storage enclosure and a lid connected to the body and pivotable between a closed position blocking access to the enclosure and an open position permitting access to the enclosure. The body includes front, rear, and first and second side body walls each extending upward from a bottom body wall to an upper edge to define the storage enclosure therebetween, and a first body flange extending laterally outward from a bottom end of the upper portion of the first body side wall and defining a plurality of body lock apertures. The lid includes front and first and second side lid walls extending downward from a top lid wall to a lower edge to overhang upper portions of the front and first and second side body walls when the lid is in the closed position, and a first lid flange extending laterally outward from the lower edge of the first lid side wall and defining a plurality of lid lock apertures that align with the plurality of body lock apertures when the lid is in the closed position. The padlock includes a padlock shackle securable with a lock body. When the padlock shackle of the at least one padlock is inserted through aligned ones of the plurality of lid lock apertures and the plurality of body lock apertures and secured with the lock body to prevent movement of the lid with respect to the body of the at least one lockbox, the padlock is positionable entirely laterally outward of the first body side wall and entirely below the lid top wall.

According to an exemplary embodiment of the present application, a lockable enclosure includes a housing and an access door. The housing includes an upper wall, a lower wall, and first and second side walls each extending forward from a rear wall to a front end to define a storage cavity therebetween. The access door includes a hinge portion connected with the lower wall, and is pivotable about a longitudinal axis of the lower hinge portion between a closed position blocking access to the cavity and an open position permitting access to the cavity. When the access door is in the closed position, the access door is slideable along the longitudinal axis between an interlocking position in which an interlock portion of the access door interlocks with a corresponding interlock portion of the upper wall to secure the access door in the closed position, and a release position in which the access door interlock portion of the access door disengages from the upper wall interlock portion to permit pivoting movement of the access door from the closed position to the open position. The access door further comprises a locking feature configured to secure the closed access door in the interlocking position in a locked condition and to permit sliding movement of the closed access door to the release position in an unlocked condition.

According to another exemplary embodiment of the present application, a document display apparatus includes a wall mountable substrate and at least one document retaining frame having upper, lower, and first and second side wall portions surrounding a transparent central portion, with the at least one document retention frame being hingedly connected to the wall mountable substrate along the first side wall portion for pivoting movement of the first document retaining frame between a document display position in which a rear surface of the at least one document retaining frame abuts the wall mountable substrate, and a document access position, in which the rear surface of the document retaining frame is exposed. A document mounting feature is connected with the at least one document retaining frame, and is configured to releasably secure a document to the rear surface of the at least one document retaining frame against the transparent central portion. A frame attachment feature is assembled with one of the wall mountable substrate and the at least one document retaining frame, and is movable between a frame securing position securing the second side wall portion to the wall mountable substrate, and a frame releasing position permitting pivoting movement of the at least one document retaining frame from the document display position to the document access position.

BRIEF DESCRIPTION OF THE DRAWINGS

Further features and advantages of the invention will become apparent from the following detailed description made with reference to the accompanying drawings, wherein.

DETAILED DESCRIPTION

Figure 1:
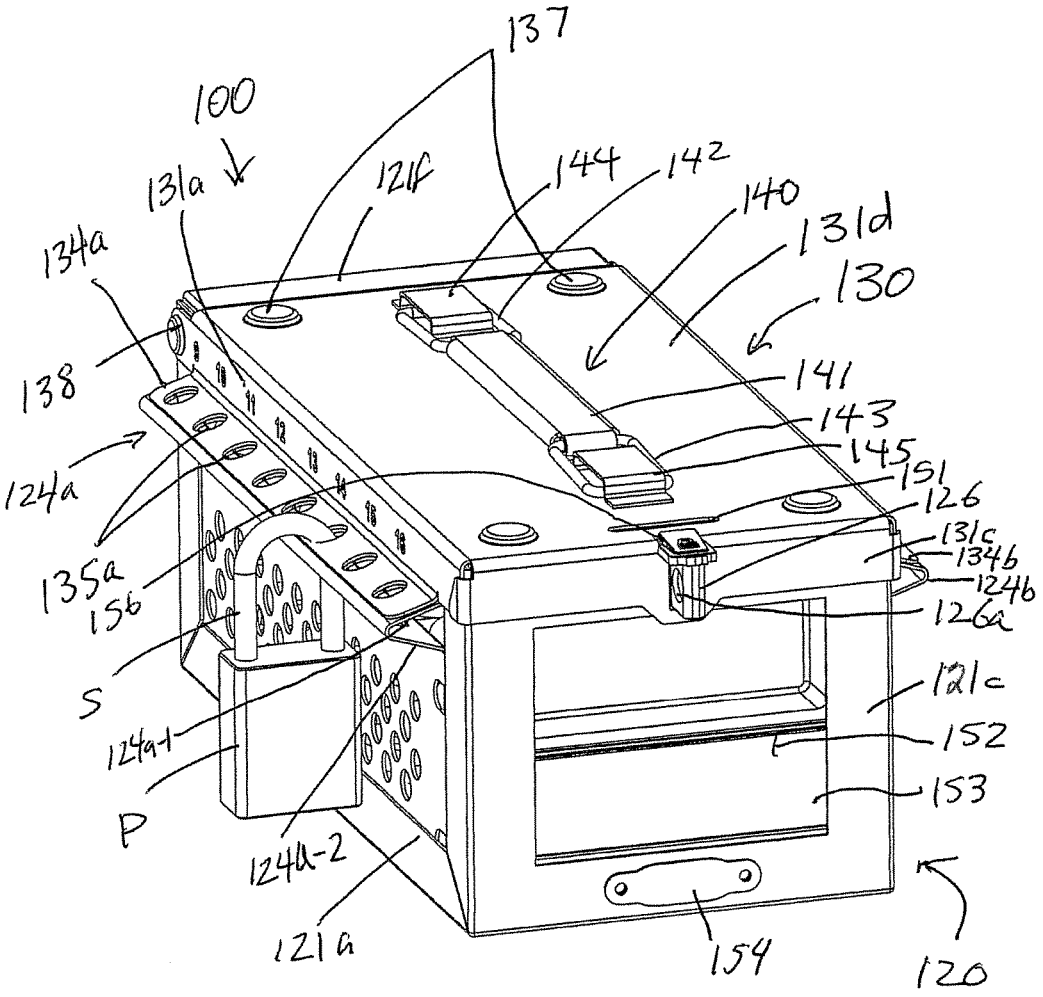
FIG. 1 illustrates an upper front perspective view of a lockbox, shown with the lid in a closed and latched position, in accordance with an exemplary embodiment.
Figure 2:
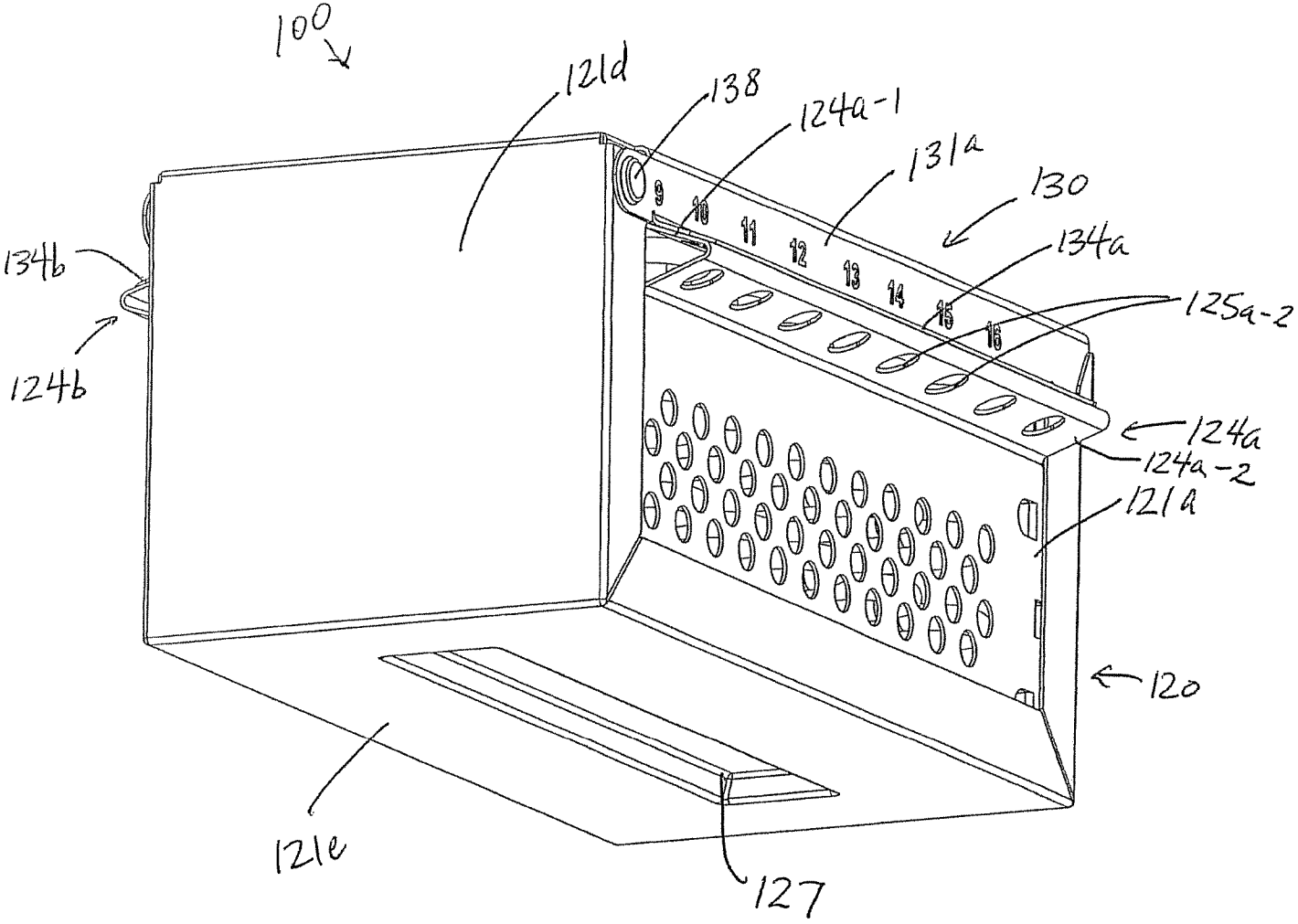
FIG. 2 illustrates a lower rear perspective view of the lockbox of FIG. 1.
Figure 3:
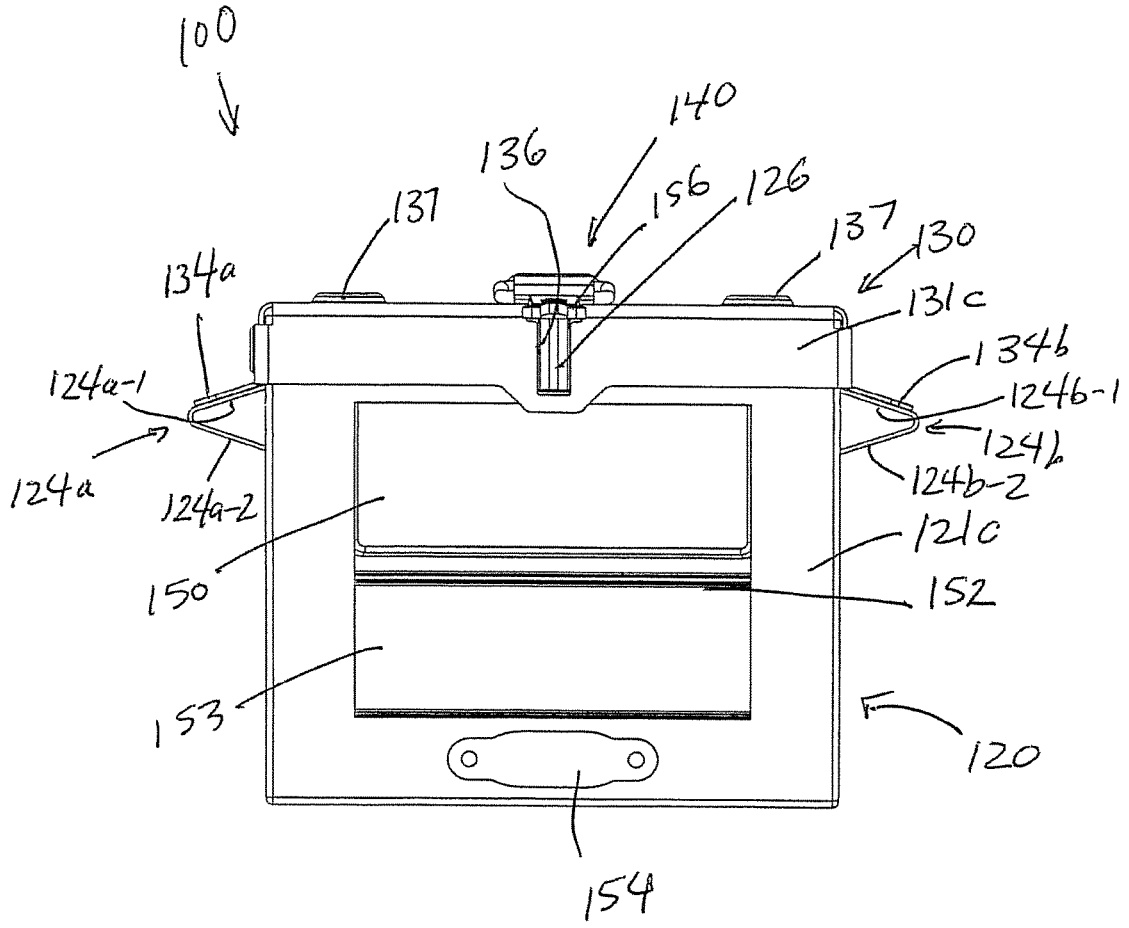
FIG. 3 illustrates a front view of the lockbox of FIG. 1.

The Detailed Description merely describes exemplary embodiments is not intended to limit the scope of the claims in any way. Indeed, the invention as claimed is broader than and unlimited by the exemplary embodiments, and the terms used in the claims have their full ordinary meaning.

Also, while specific exemplary embodiments in the present application describe padlock secured group lockboxes and lockout stations for storing multiple padlocks and keys for locking out and unlocking portions of a system or equipment, one or more of the features described herein may additionally or alternatively be applied to other types of locking enclosures (e.g., safes, mailboxes, drop boxes, etc.) and to other types of locking mechanisms (e.g., combination padlocks, electronic locks, RFID locks, built-in key operated locks, combination locks, remote controlled locks, biometric operated locks, etc.). Likewise, while specific exemplary embodiments in the present application describe a document display apparatus for displaying documents related to a system lockout (e.g., permits, work orders, etc.), one or more of the features described herein may additionally or alternatively be applied to display arrangements for other types of documents or other articles or materials.

According to an aspect of the present application, a locking enclosure is provided with multiple locking points, such that the cooperation of multiple authorized users may be required to open the enclosure. When one or more locking points of the enclosure are secured in a locked condition, each of the one or more locking points must be unlocked or released to open the enclosure. In one such embodiment, a locking enclosure may be provided with multiple sets of lock apertures, with the locking enclosure being configured to be secured in a closed condition when a padlock shackle or other such locking member (e.g., a cable lock, pin lock, zip tie) is secured through at least one of the sets of lock apertures.

As one example, a lockbox may be provided with a body or housing and a lid or access door movable (e.g., pivoting hinged movement, sliding movement, or fully removable) between a closed position securing one or more items within the lockbox, and an open position permitting access to, or the depositing of, items in the lockbox. The lid may be secured in the closed position by corresponding lock apertures in the body and in the lid. When a shackle (or other such locking member) is inserted through the corresponding body and lid apertures, movement of the apertured lid portion with respect to the apertured body portion is restricted to secure the lid in the closed position.

Multiple user lockboxes having lock apertures in the side wall portions of the body and the top wall portion of the lid may provide for multiple lock points for multiple user lockout of the lockbox, to restrict access to the contents of the lockbox. An exemplary embodiment of a multiple user lockbox with side and top wall lock apertures is disclosed in co-owned U.S. Pat. No. 7,360,380, the entire disclosure of which is incorporated herein by reference.

In some applications, the use of several multiple user lockboxes may be desirable for separate lockout procedures involving multiple systems in a factory or other setting. In such applications, it may be desirable to provide lockboxes that may be stacked on top of each other when in a lockout condition (i.e., with padlocks secured through one or more of the sets of lock apertures), for example, to maintain the lockboxes in a smaller space, or organized in separate stacks for different areas or systems within a plant. Where the lock apertures are arranged such that the installed padlock shackle extends above the top wall of the lid (e.g., through an aperture in the top wall portion of the lid), the padlock shackle may interfere with or prevent stacking of two or more lockboxes. Further, the angled orientation of a padlock installed through aligned apertures in the lid top wall and body side wall may result in the padlock being angled laterally outward from the lockbox, resulting in an increased footprint width of the locked out lockbox. Additionally, padlock shackles installed through aligned apertures in the lid top wall and body side wall extend into the lockbox enclosure, potentially reducing the storage space within the lockbox.

According to an aspect of the present application, a lockbox may be provided with body and lid lock apertures arranged to facilitate stacking of the locked out lockboxes, reduce footprint width or height of the locked out lockboxes, and/or maximize storage enclosure space within the locked out lockbox. In one embodiment, lid lock apertures are disposed on a lid flange extending outward from a bottom edge portion of the lid, in alignment with body lock apertures disposed on a body flange extending outward from the base of an upper wall portion of the body. In an exemplary embodiment, the lid and body flanges may be recessed or vertically offset from the top wall of the lid, such that when a padlock is secured to the aligned lid and body lock apertures of the lid and body flanges, the padlock does not extend above the top surface of the lid.

Figure 4:
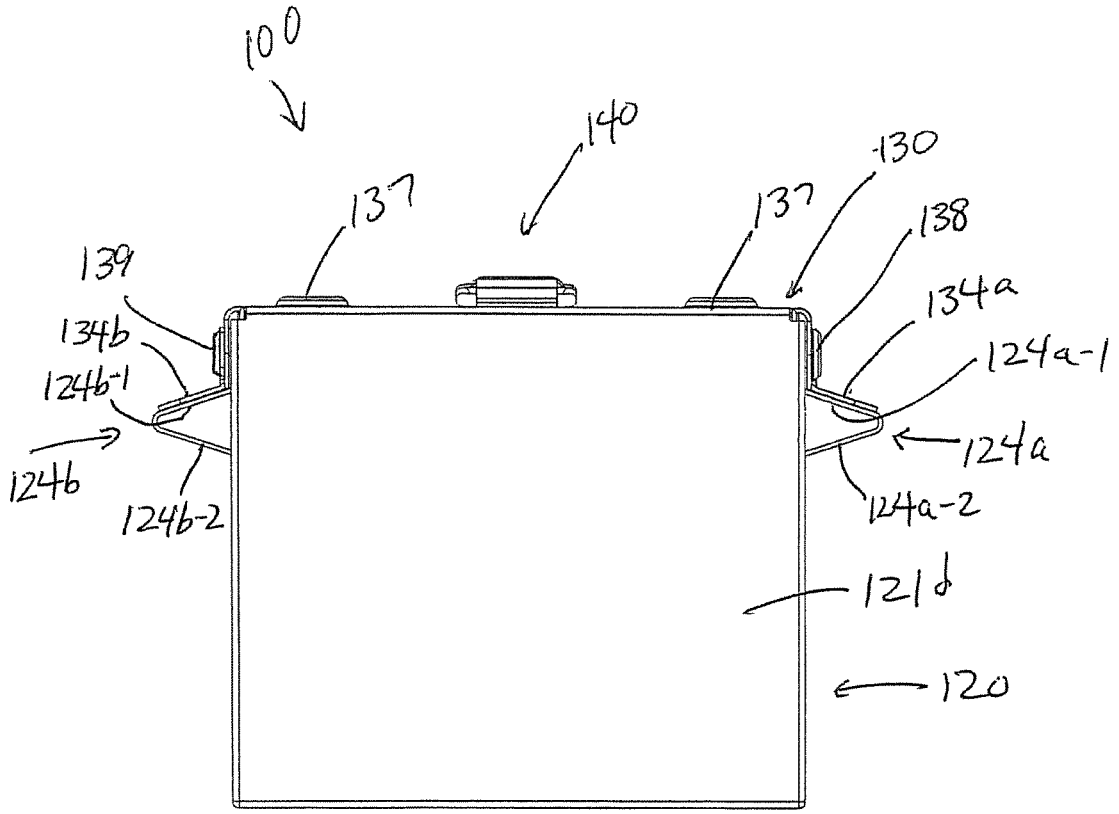
FIG. 4 illustrates a rear view of the lockbox of FIG. 1.
Figure 5:
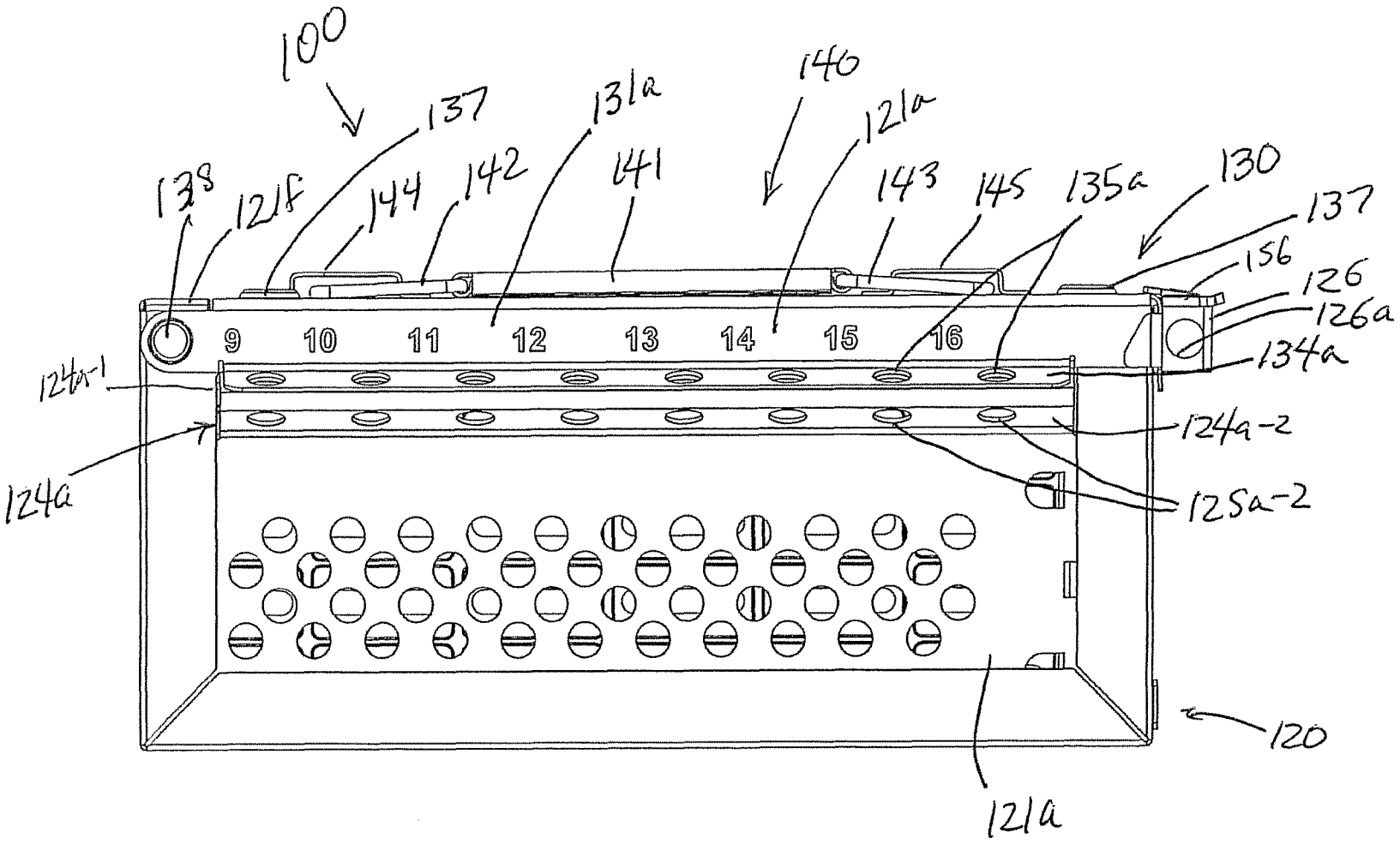
FIG. 5 illustrates a left side view of the lockbox of FIG. 1.
Figure 6:
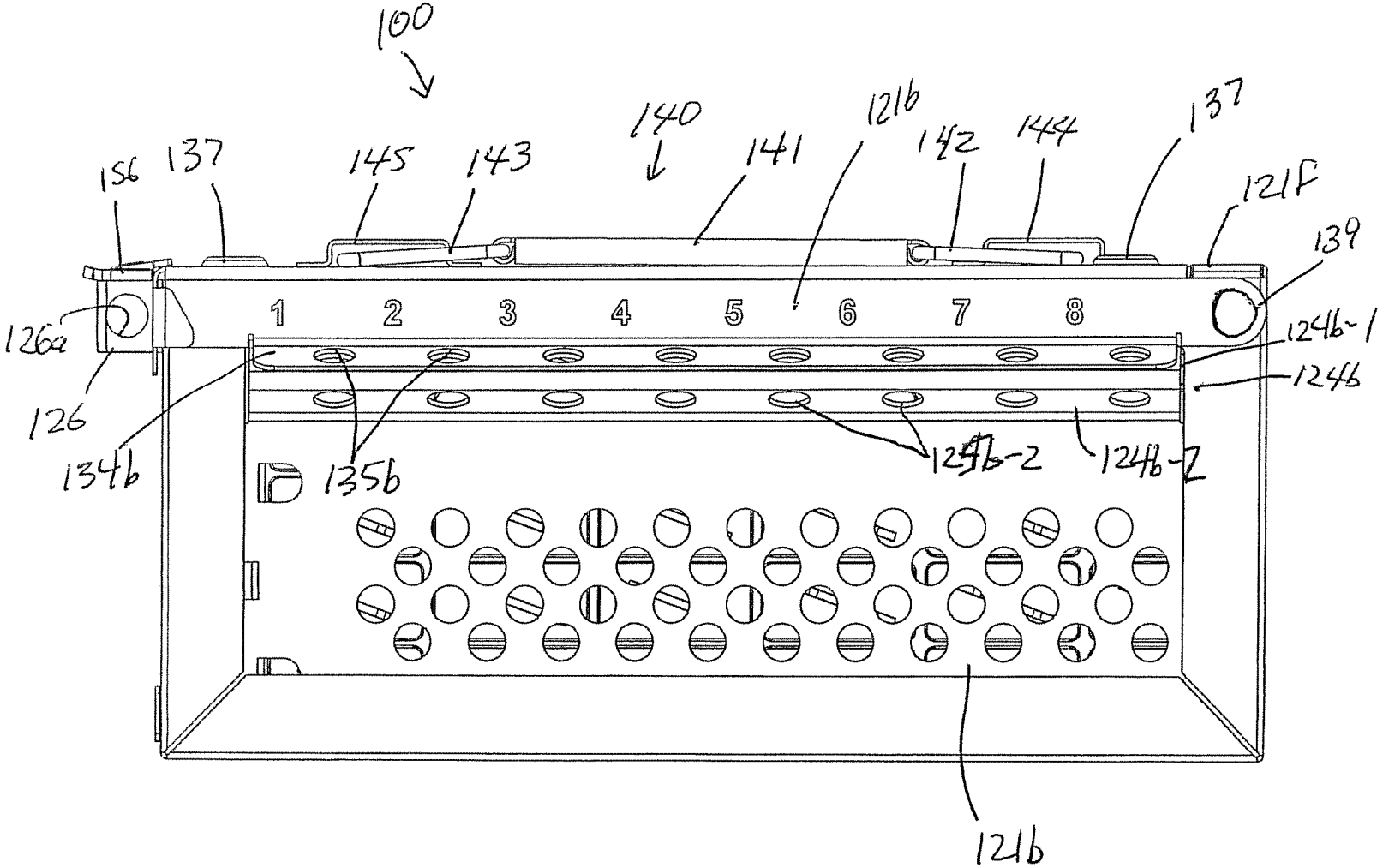
FIG. 6 illustrates a right side view of the lockbox of FIG. 1.
Figure 7:
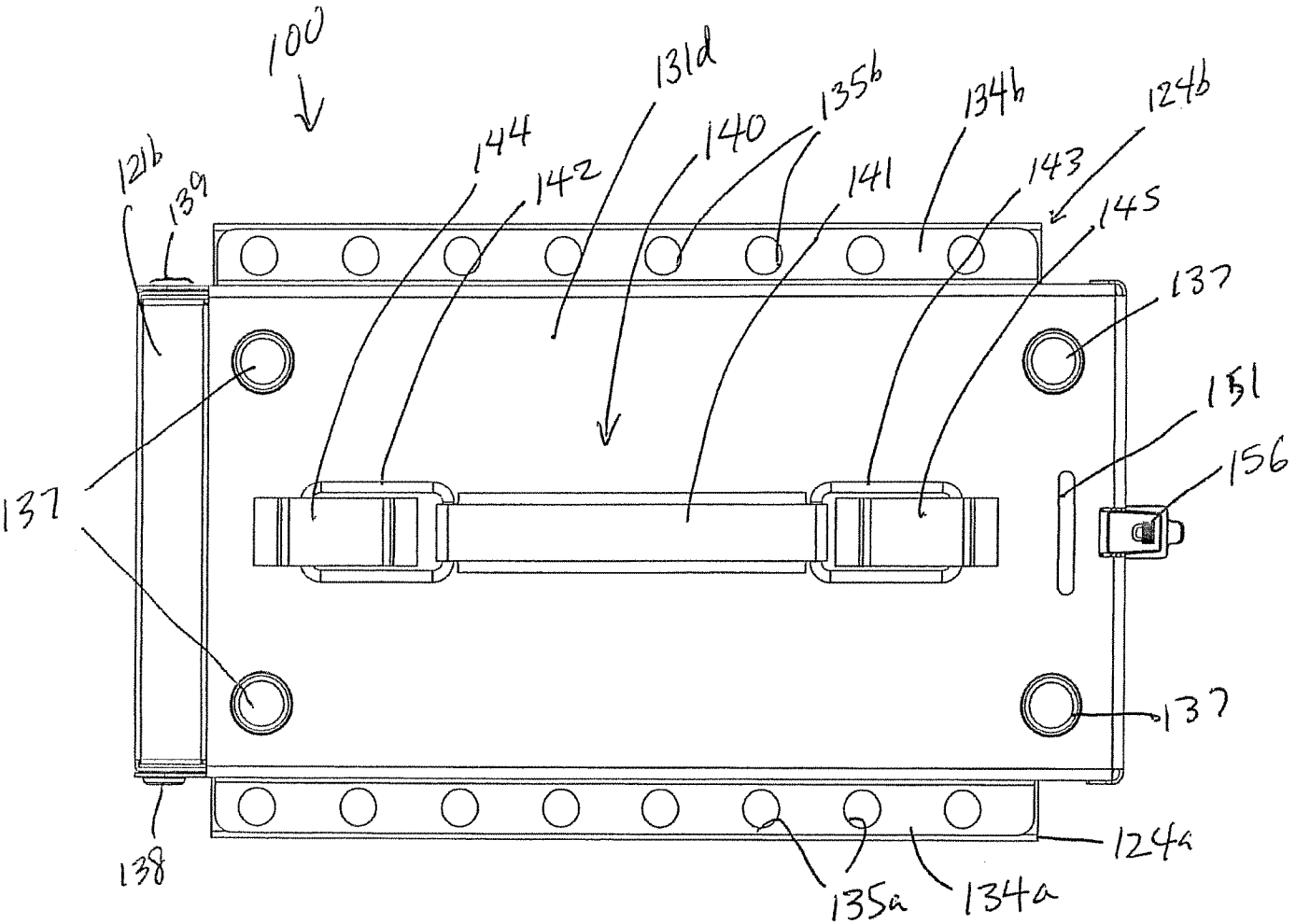
FIG. 7 illustrates a top view of the lockbox of FIG. 1.
Figure 8:
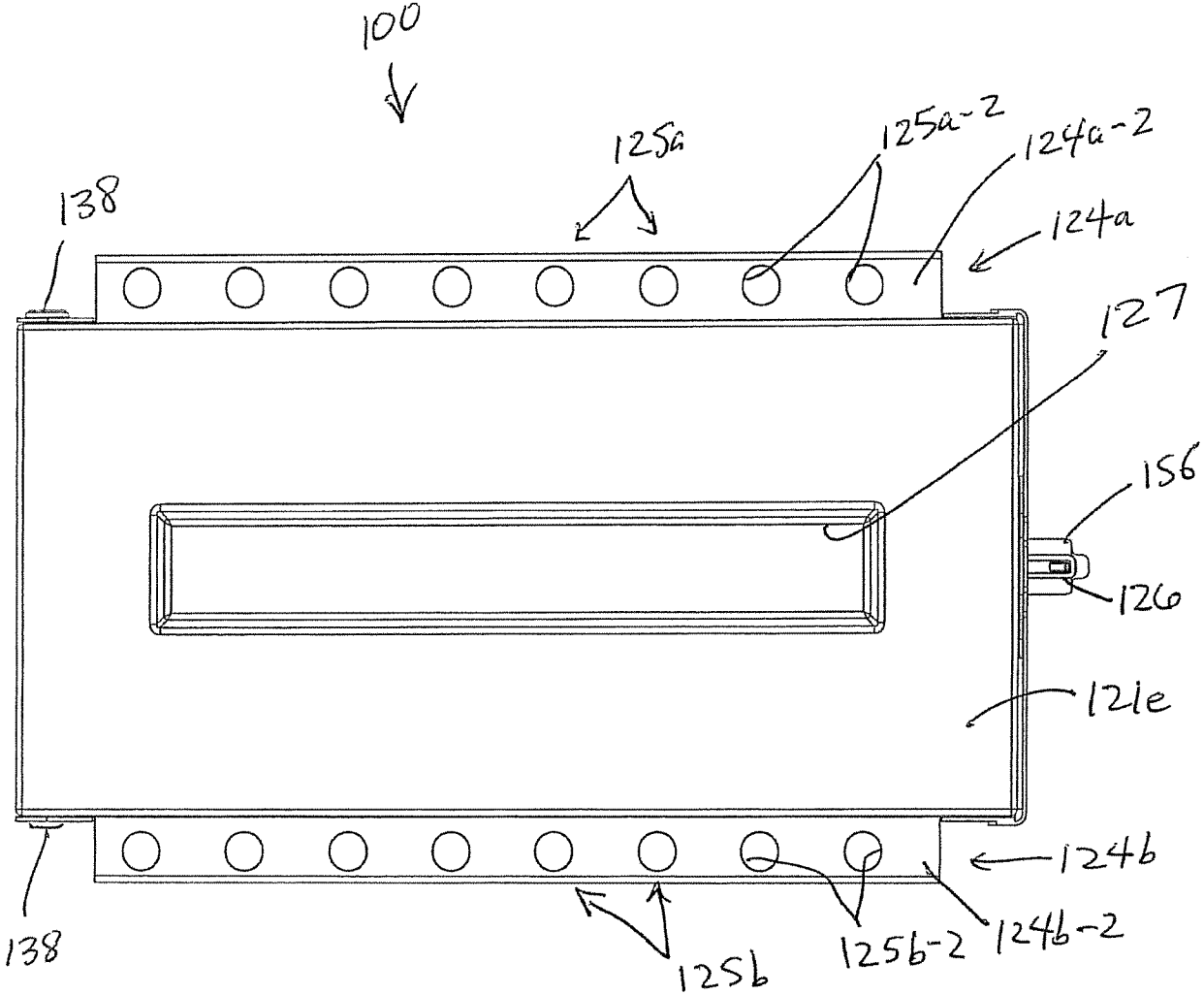
FIG. 8 illustrates a bottom view of the lockbox of FIG. 1.

FIGS. 1-11 illustrate various views of an exemplary lockbox 100 in accordance with the present application. The lockbox 100 includes a housing or body 120 and an access door or lid 130 pivotally connected to the body 120 for pivoting movement between a closed position (FIGS. 1 and 3) and an open position (FIG. 4). The body 120 includes left side, right side, front, and rear walls 121*a*, 121*b*, 121*c*, 121*d* extending from a bottom wall 121*e* to define a storage enclosure 123. The storage enclosure may be sized to retain a variety of items. In one embodiment the storage enclosure is sized to closely retain (e.g., with minimal extra space to limit shifting of the contents) a set of padlocks P (e.g., 25-50 padlocks) with installed keys K for use in one or more lockout devices (e.g., valve lockouts, electrical connection lockouts, circuit breaker lockouts, etc.) in a safety lockout system. The lid 130 includes left side, right side, and front walls 131*a*, 131*b*, 131*c* that extend from a top wall 131*d* of the lid 130 to overhang upper portions 122*a*, 122*b*, 122*c* (see FIG. 11) of the left side, right side, and front body walls 121*a*, 121*b*, 121*c*. While any suitable pivotable connection between the lid and the body may be utilized, in the illustrated embodiment, the lid 130 is pivotably connected to the body 120 by a hinge portion defined by pivot pins 138, 139 pivotably attaching rear portions of the left and right side lid walls 131*a*, 131*b* to the upper portions 122*a*, 122*b* of the left and right side body walls 121*a*, 121*b*. By providing this pivotable connection forward of the rear or base body wall 121*d* (for example, as compared to a rear hinge), the rear portion of the lid 130 does not protrude rearward of the rear body wall 121*d*, thereby reducing the footprint depth of the open lockbox. To provide coverage for the storage enclosure 123 rearward of the rear edge of the top lid wall 131*d*, the rear body wall 131*d* may include a forward extending flange 121*f* that abuts the rear edge of the top lid wall 131*d* when the lid 130 is in the closed and latched position.

The illustrated lockbox 100 includes left and right side lid flanges 134*a*, 134*b* extending laterally outward from bottom edges of the left and right side lid walls 131*a*, 131*b*, and left and right side body flanges 124*a*, 124*b* extending laterally outward from bottom ends of the upper portions 122*a*, 122*b* of the left and right side body walls 121*a*, 121*b*. When the lid is in the closed position, the lid flanges 134*a*, 134*b* overlie (and may, but need not, abut) the body flanges 124*a*, 124*b*, such that lock apertures 135*a*, 135*b* in the lid flanges

134*a*, 134*b* align with corresponding lock apertures 125*a*, 125*b* in the body flanges 124*a*, 124*b* to provide multiple lock points for receiving locking members (e.g., padlocks). The lock apertures may be sized to closely receive a padlock shackle, including for example shackles having cross-sectional diameters of approximately 3/16 inch, 1/4 inch, 9/32 inch, 5/16 inch, 3/8 inch, and 7/16 inch, or any other suitable shackle size. The lock apertures may be coded or identified on the lockbox (e.g., by alphanumerical markings on the lid side walls 131*a*, 131*b* above each lid lock aperture 135*a*, 135*b*) to associate a lock point with a corresponding padlock or system user to which that code or designator has been assigned.

While any number of sets of lock apertures may be provided, a large number of sets of lock apertures may be desirable for applications in which a large number of workers are involved in the lockout procedures. In the illustrated embodiment, sixteen sets of lock apertures 125*a*, 135*a*, 125*b*, 135*b* are provided for sixteen lock points, eight on each side flange. Where additional lock points are needed, a safety lockout hasp (providing multiple lock points retaining the hasp in a closed position) may be installed in one or more of the sets of lock apertures 125*a*, 135*a*, 125*b*, 135*b*. Exemplary safety lockout hasps are described in co-owned U.S. Pat. No. 8,408,609, the entire disclosure of which is incorporated by reference herein.

To provide stronger, more rigid flanged portions, the body flanges 124*a*, 124*b* may include includes downward angled upper flange walls 124*a*-1, 124*b*-1 and upward angled lower flange walls 124*a*-2, 124*b*-2 joined to form a V-shape in cross-section, with each body lock aperture 125*a*, 125*b* formed from aligned upper and lower holes 125*a*-1, 125*b*-1, 125*a*-2, 125*b*-2 in the upper and lower flange walls 124*a*-1, 124*b*-1, 124*a*-2, 124*b*-2. The lid flanges 134*a*, 134*b* may be oriented at a downward angle to closely overlie or abut the upper flange walls 124*a*-1, 124*b*-1.

The height of the side lid walls 131*a*, 131*b* (and the corresponding upper portions 122*a*, 122*b* of the side body walls 121*a*, 121*b*) may be selected to provide a sufficient offset of the lid flanges 134*a*, 134*b* from the top surface of the top lid wall 131*d* to prevent the padlock shackle S (or other locking member) from extending above the lid top wall 131*d*, to minimize a vertical footprint of the locked out lockbox 100. In an exemplary embodiment, this vertical offset may be at least the diameter of the lock apertures 125*a*, 125*b*, 135*a*, 135*b*, and/or at least the height of the curved upper portion of the padlock shackle intended to be used with the lockbox 100. The lateral positions of the lock apertures 125*a*, 125*b*, 135*a*, 135*b* on the body and lid flanges 124*a*, 124*b*, 134*a*, 134*b* may be selected to provide sufficient clearance for the side of the padlock body extending laterally inward from the inserted shackle leg from the side body wall 121*a*, 121*b*, such that the installed padlock P may extend substantially vertically, without being angled outward from the lockbox 100, to minimize a horizontal footprint of the locked out lockbox.

Figure 9:
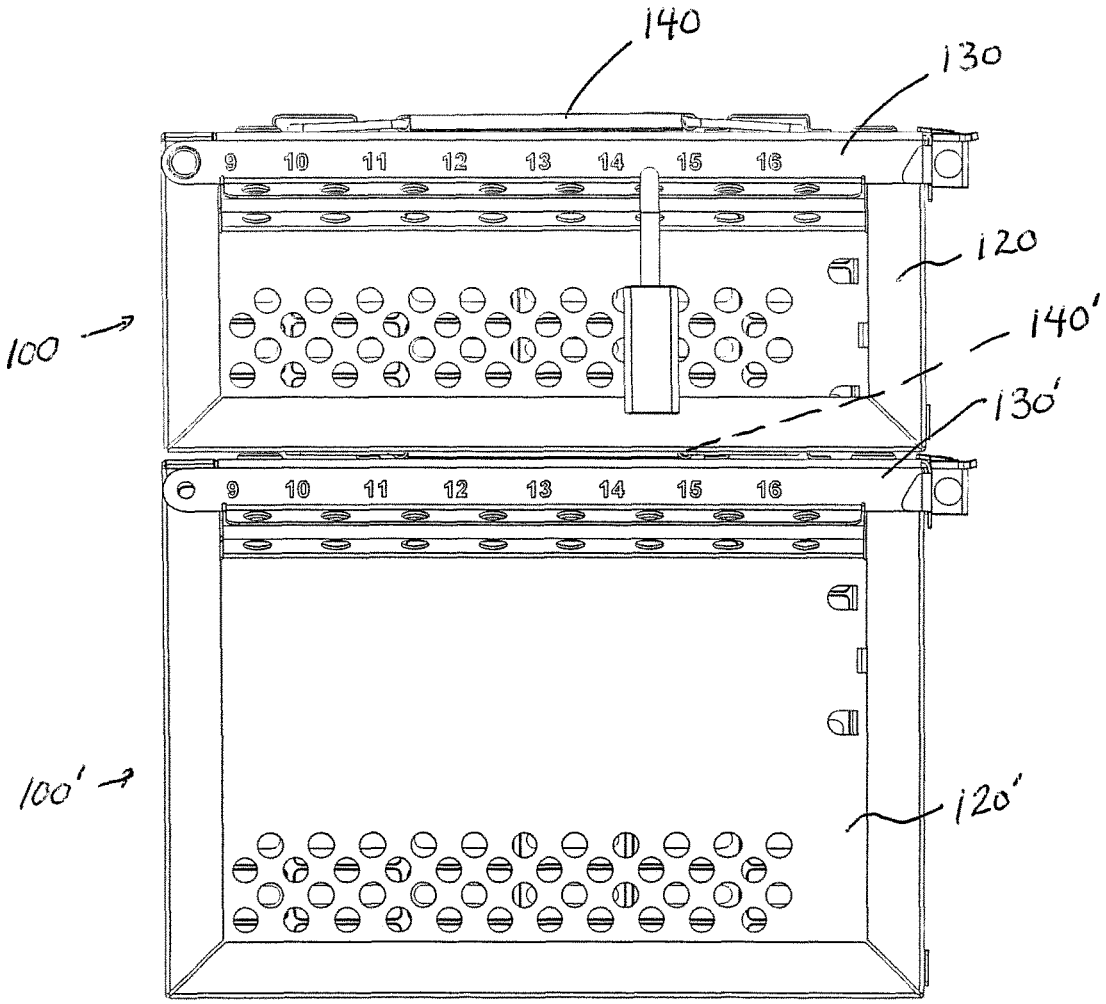
FIG. 9 illustrates a side view of the lockbox of FIG. 1, shown stacked with another lockbox in accordance with an exemplary embodiment.
Figure 10:
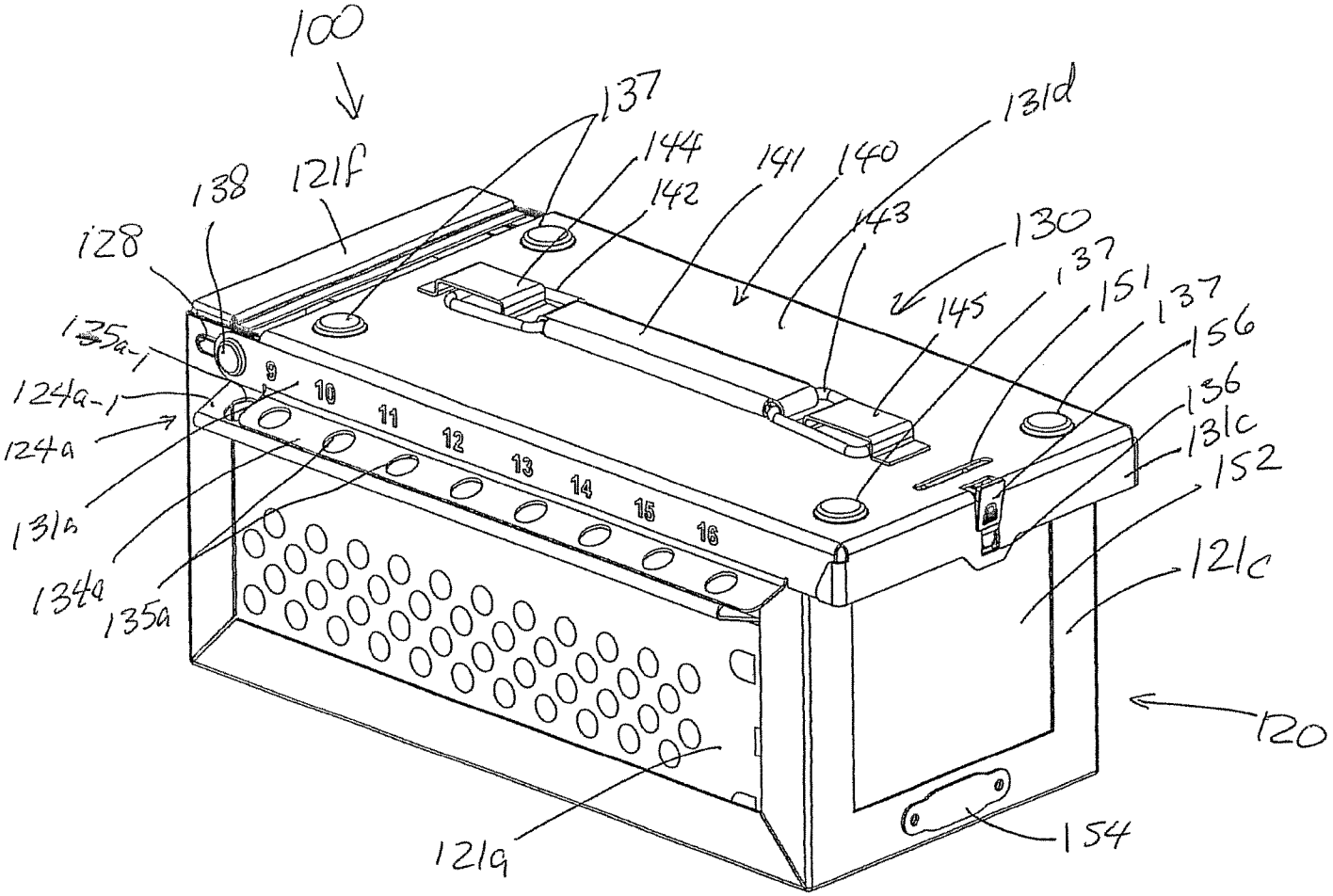
FIG. 10 illustrates an upper perspective view of the lockbox of FIG. 1, shown with the lid in a closed and unlatched position.
Figure 11:
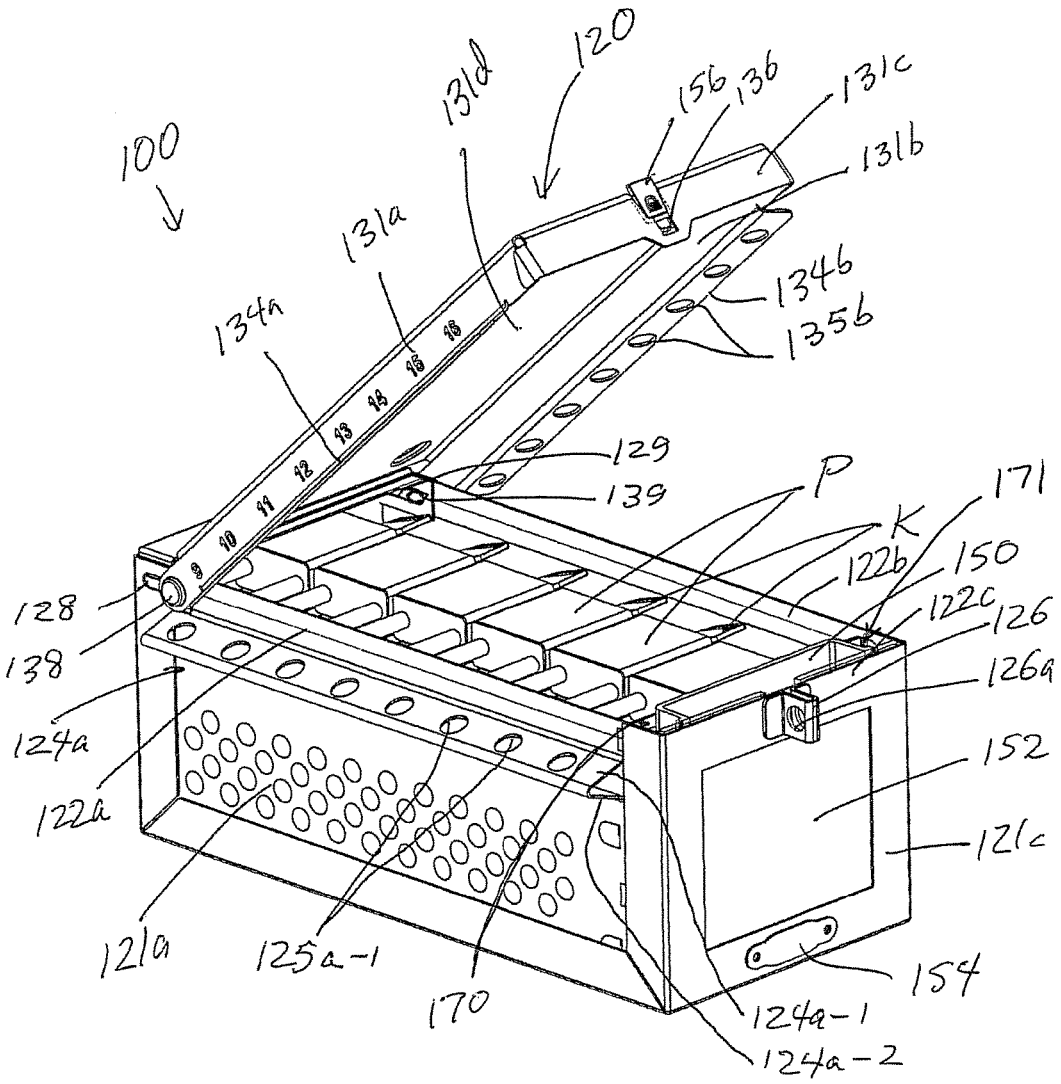
FIG. 11 illustrates an upper perspective view of the lockbox of FIG. 1, shown with the lid in an open position.

Other features may additionally or alternatively be provided to facilitate stacking and/or minimize footprint size of the locked out lockbox. For example, the lockbox 100 may be provided with a handle 140 including a handle bar 141 secured to pivotable links 142, 143 that are secured to slot-defining handle brackets 144, 145 attached to the lid top wall 131*d* (e.g., by welding or fasteners), such that the handle may fold flat against the lid 130. The bottom body wall 121*e* may include a recessed central portion or pocket 127 (see FIGS. 2 and 8) that is sized and shaped to receive the flattened handle 140' of a second lockbox 100' upon which that lockbox is stacked. Corner bosses 137 or other projections may additionally or alternatively provide clearance for the handle 140 of a lockbox upon which that lockbox is stacked, to facilitate level stacking. As another example, as shown in FIG. 9, different sized lockboxes 100, 100' (e.g., to contain different quantities of padlocks or other items) may be provided in differing heights, but with the same length and width dimensions, to facilitate stacking of these different sized lockboxes.

To hold the lid in the closed position, even when the lockbox is not locked out, the lid may be provided with a latch portion that interlocks with a corresponding latch portion of the body. While many different types of latching arrangements may be used, in the illustrated embodiment, the upper portion 122*c* of the front body wall 121*c* is provided with a latching tab 126 that is received through a corresponding slot 136 in the front lid wall 131*c* when the lid 130 is in a latched position, thereby preventing pivoting movement of the lid 130 to the open position. To release the lid 130 for pivoting movement to the open position, the lid is slideable in a forward direction to disengage the slot 136 in the front lid wall 131*c* from the latching tab 126. While many different lid sliding mechanisms may be utilized, in the illustrated embodiment, the pivot pins 138, 139 are slideably secured in side slots 128, 129 (see FIGS. 10 and 11) disposed in the upper portions 122*a*, 122*b* of the left and right side body walls 121*a*, 121*b*. When one or more padlocks are secured through any of the aligned body and lid lock apertures 125*a*, 125*b*, 135*a*, 135*b*, the lid 130 is blocked from sliding forward to the unlatched position. Additionally, as shown, the latching tab 126 may include a lock aperture 126*a* to provide an additional lock point for the lockbox. When a padlock is secured to the lock aperture 126*a* of the latching tab 126 (i.e., by inserting the padlock shackle through the lock aperture), the lid 130 is blocked from sliding forward to the unlatched position. This front lock point may be used by a supervisor or primary operator, as the use of this lock point may provide the most visibility and may be most easily distinguishable from other lock point use.

Figure 12:
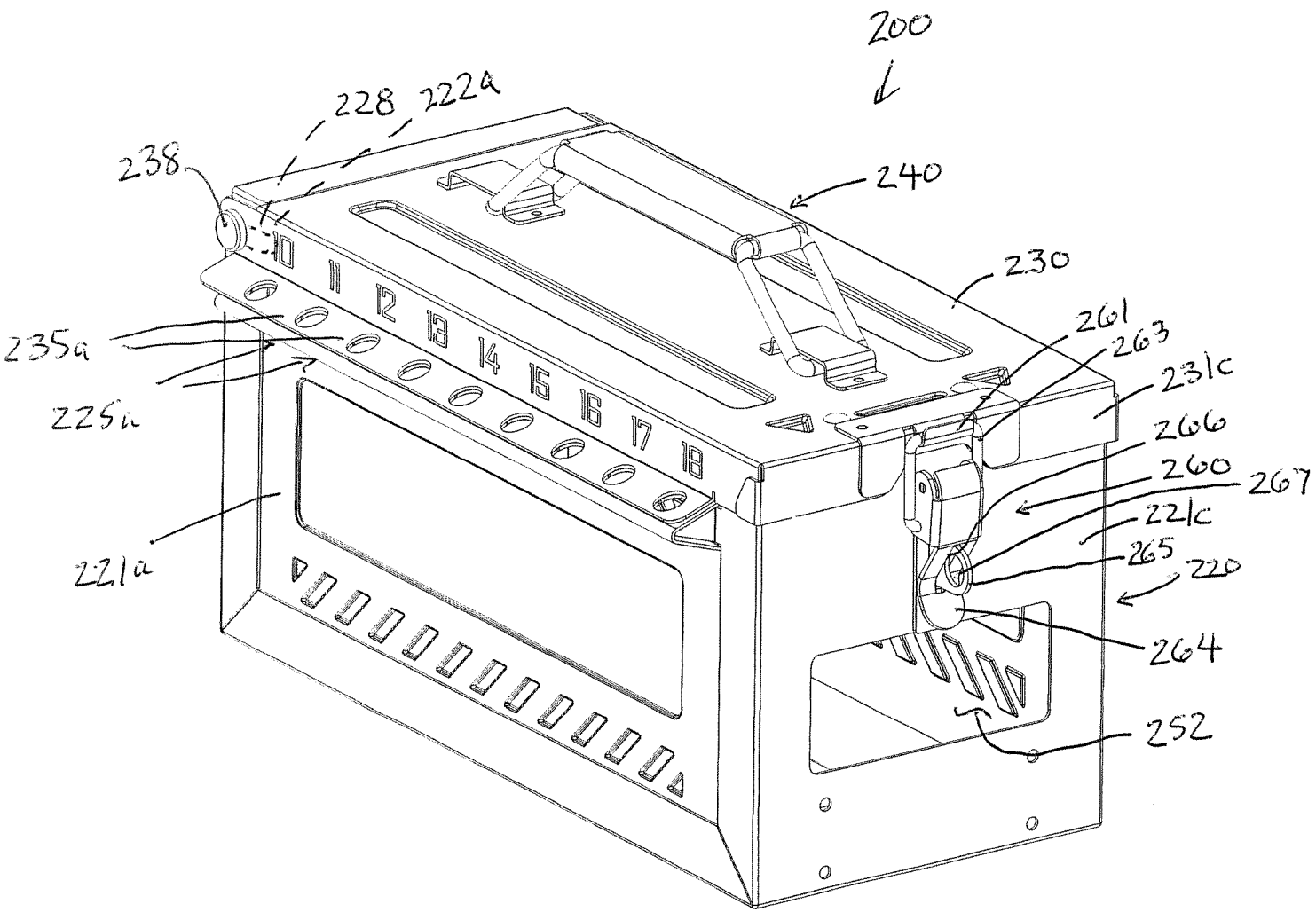
FIG. 12 illustrates an upper front perspective view of a lockbox, shown with the lid in a closed and latched position, in accordance with another exemplary embodiment.
Figure 13:
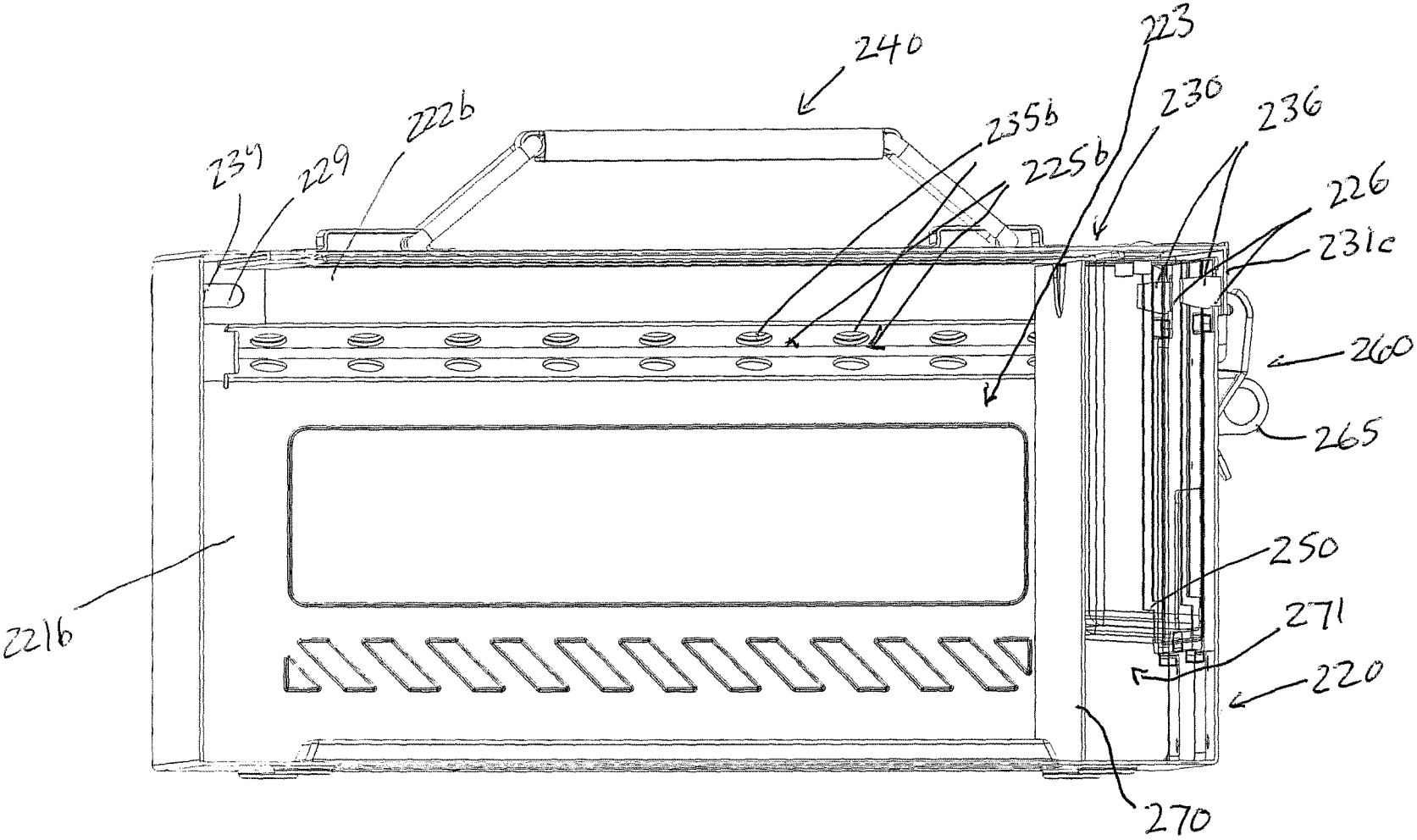
FIG. 13 illustrates a side cross-sectional view of the lockbox of FIG. 12.
Figure 14A:
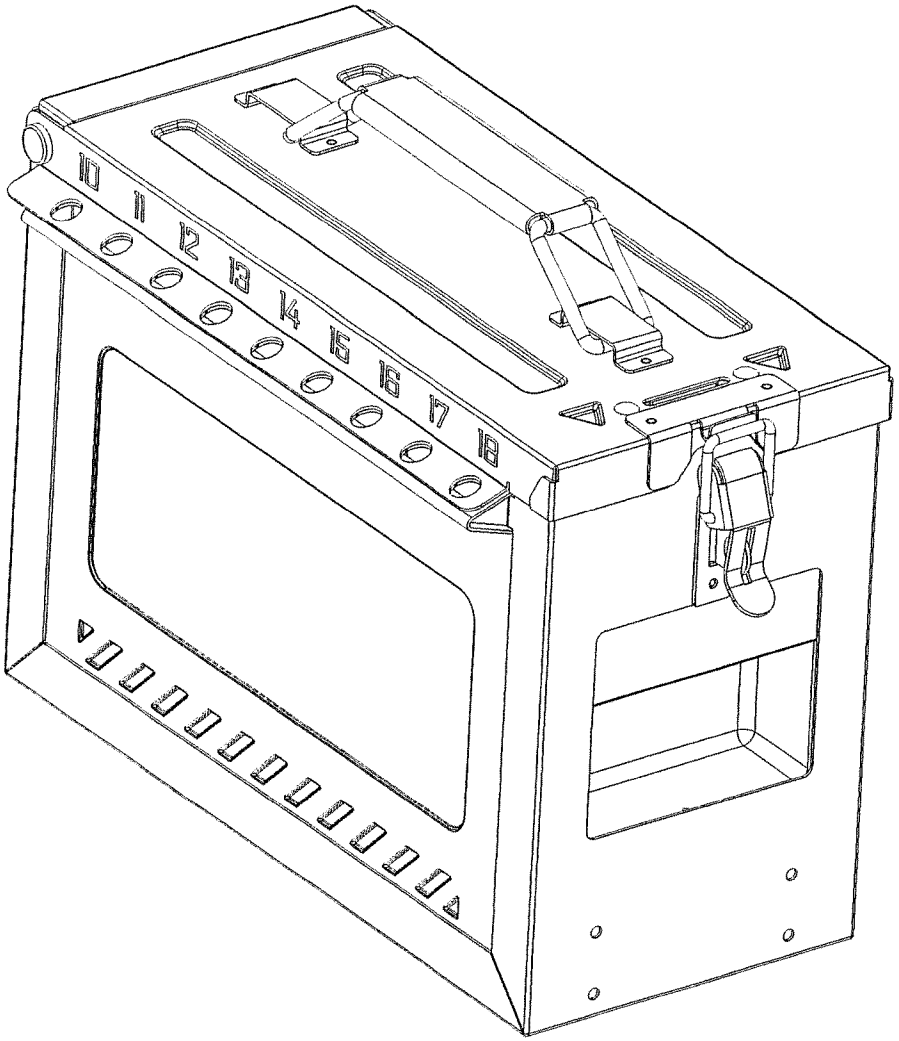
FIGS. 14A-14H illustrate top/left/front perspective, bottom/right/rear perspective, front elevational, rear elevational, left side elevational, right side elevational, top plan, and bottom plan views of an exemplary lockbox.
Figure 14B:
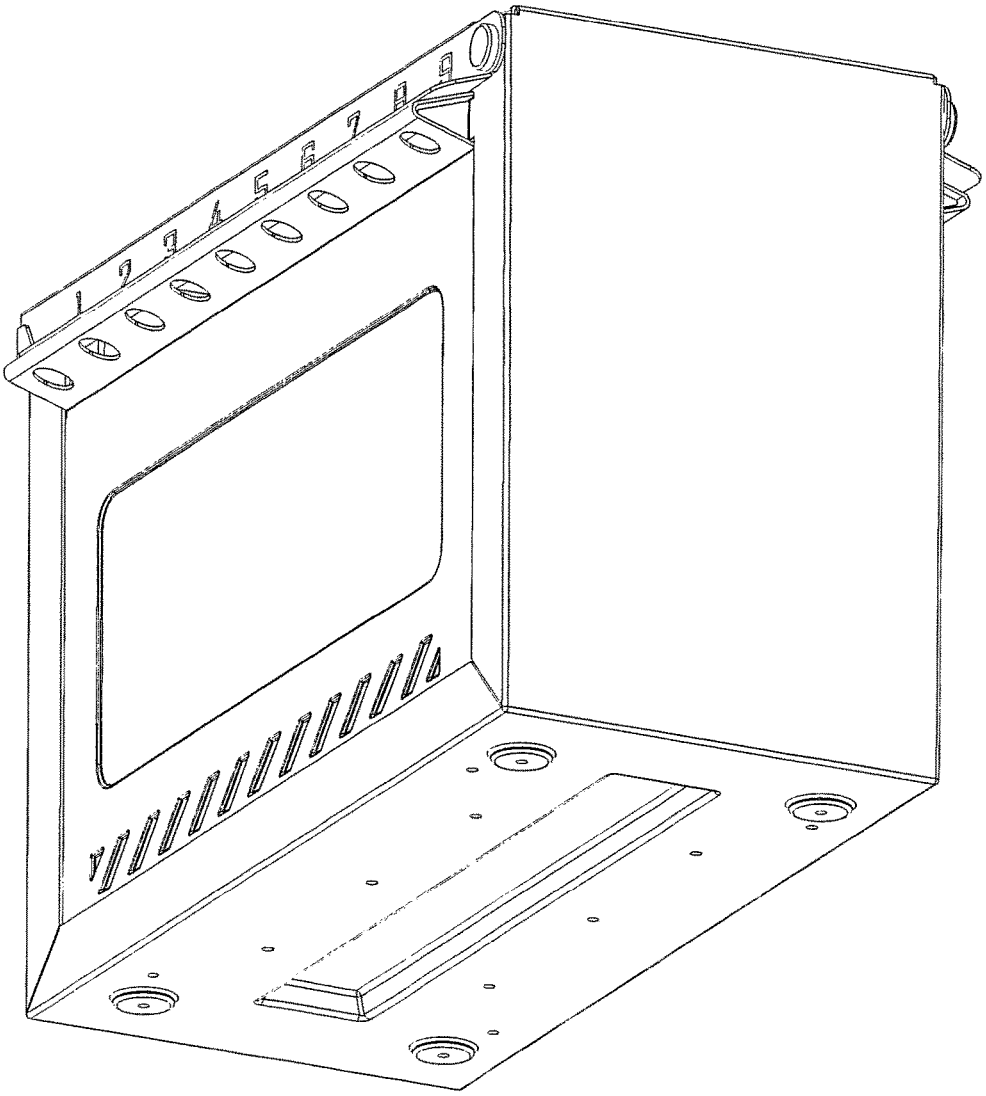
Figure 14C:
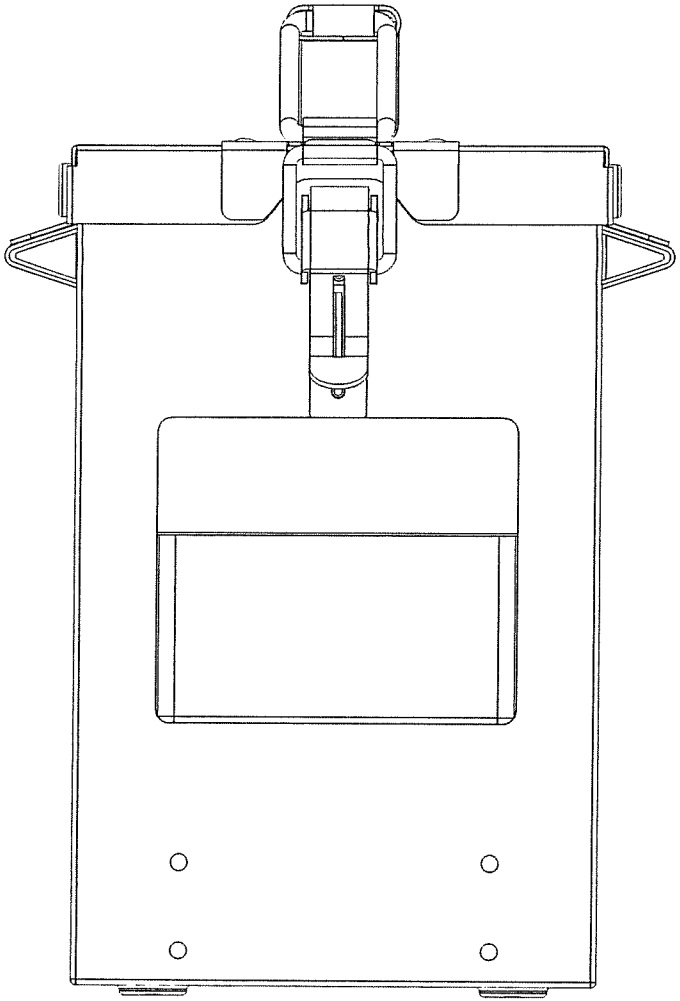
Figure 14D:
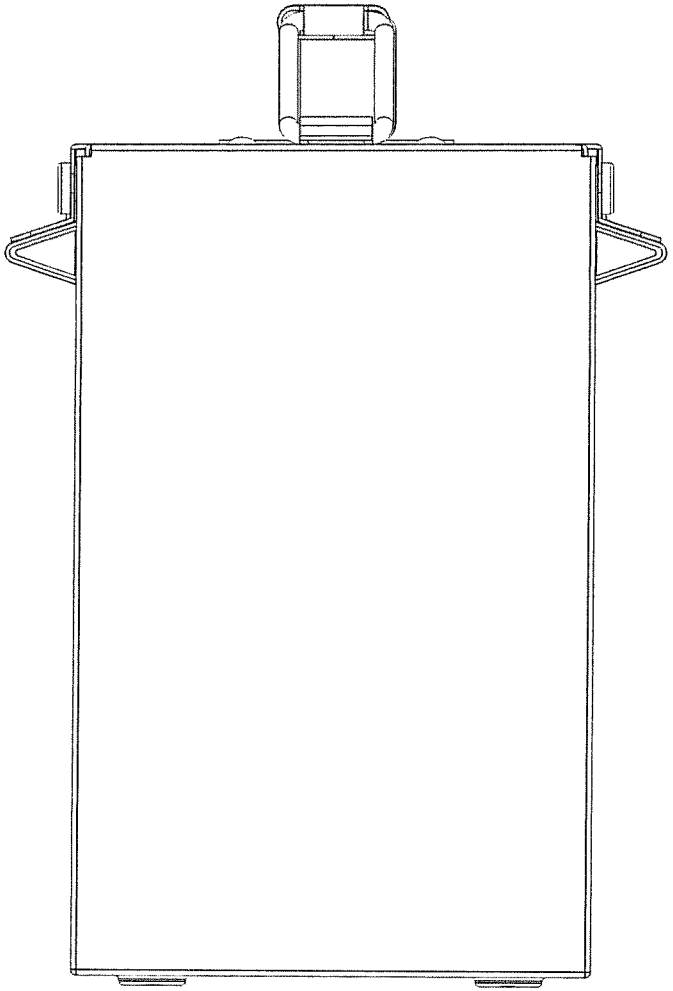
Figure 14E:
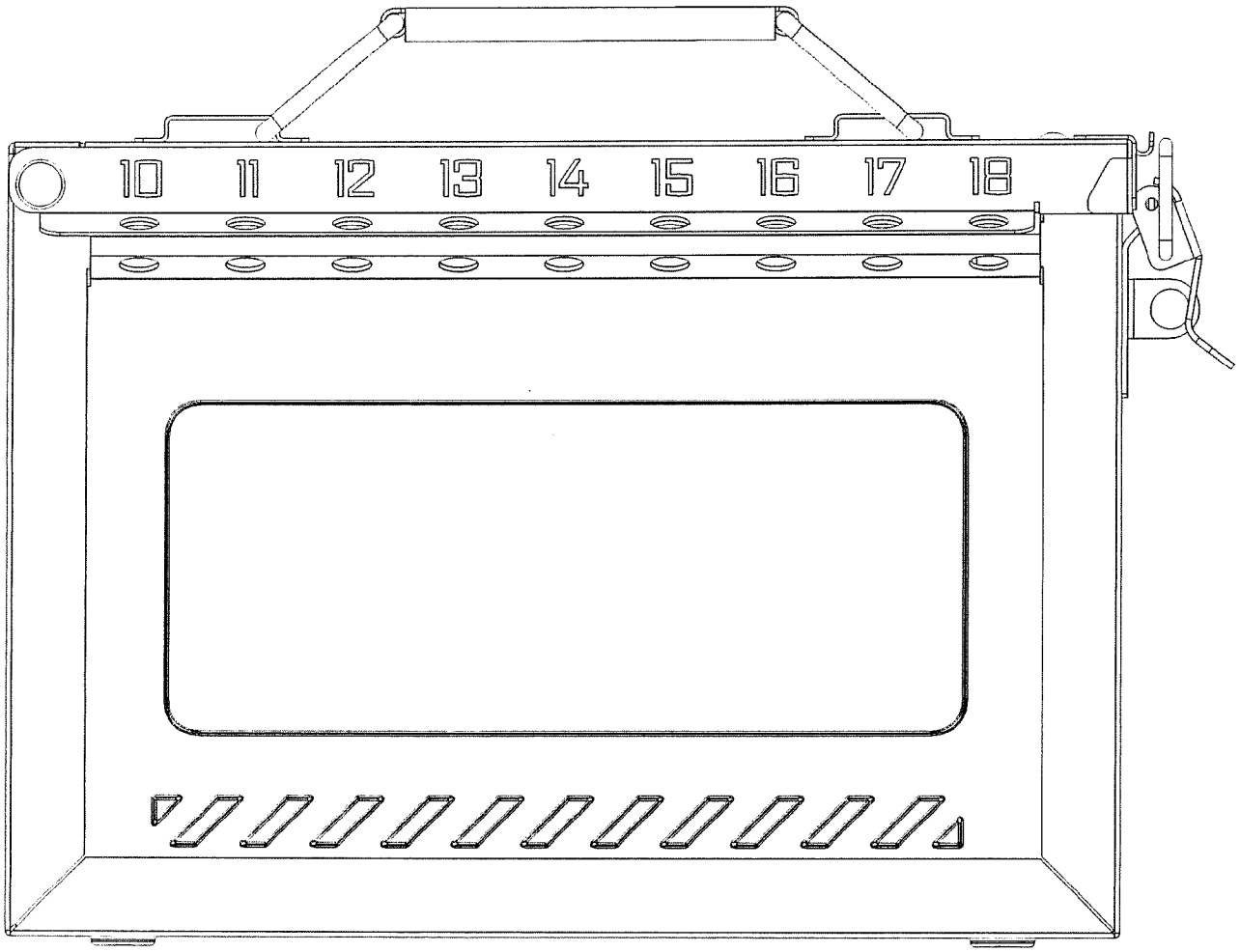
Figure 14F:
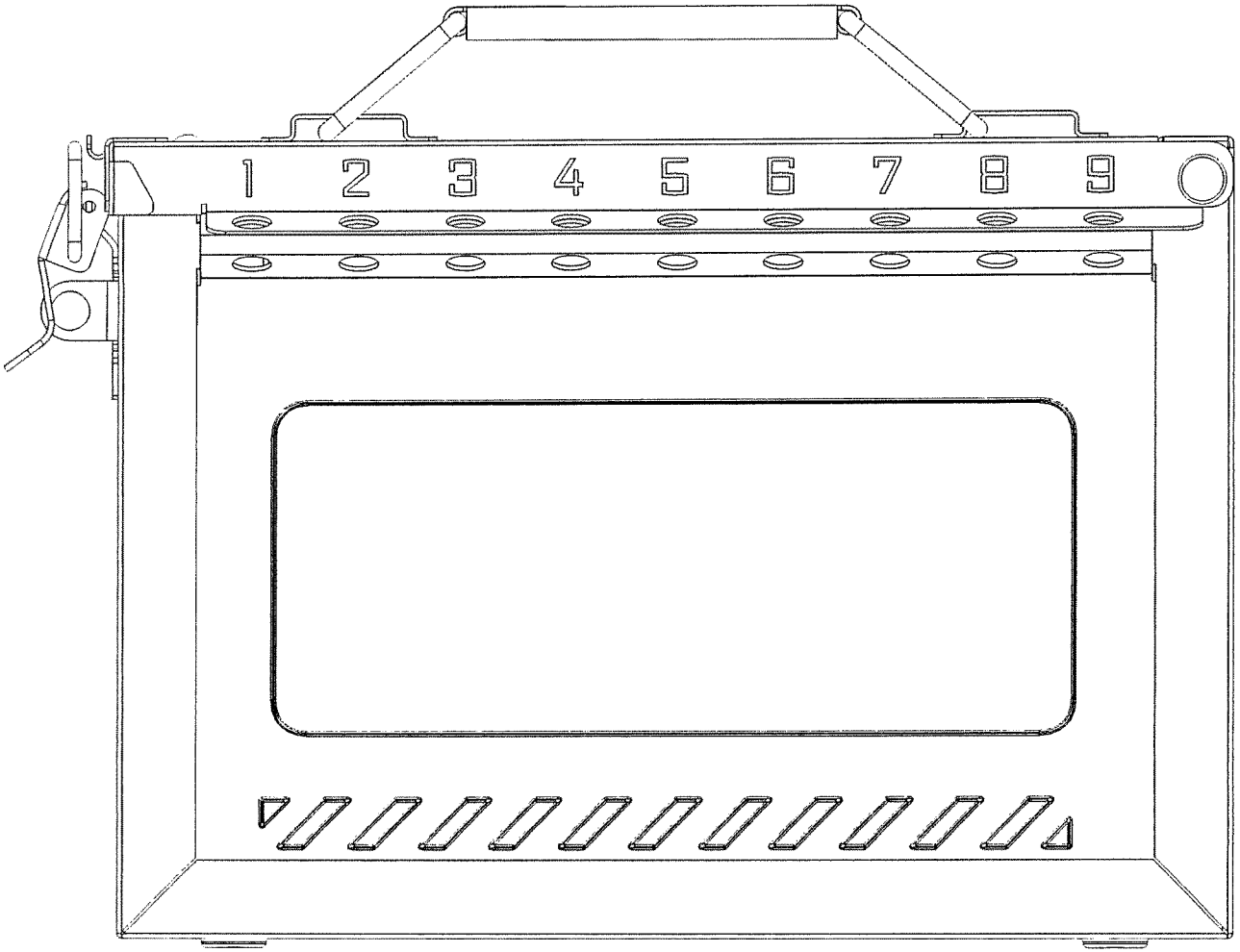
Figure 14G:
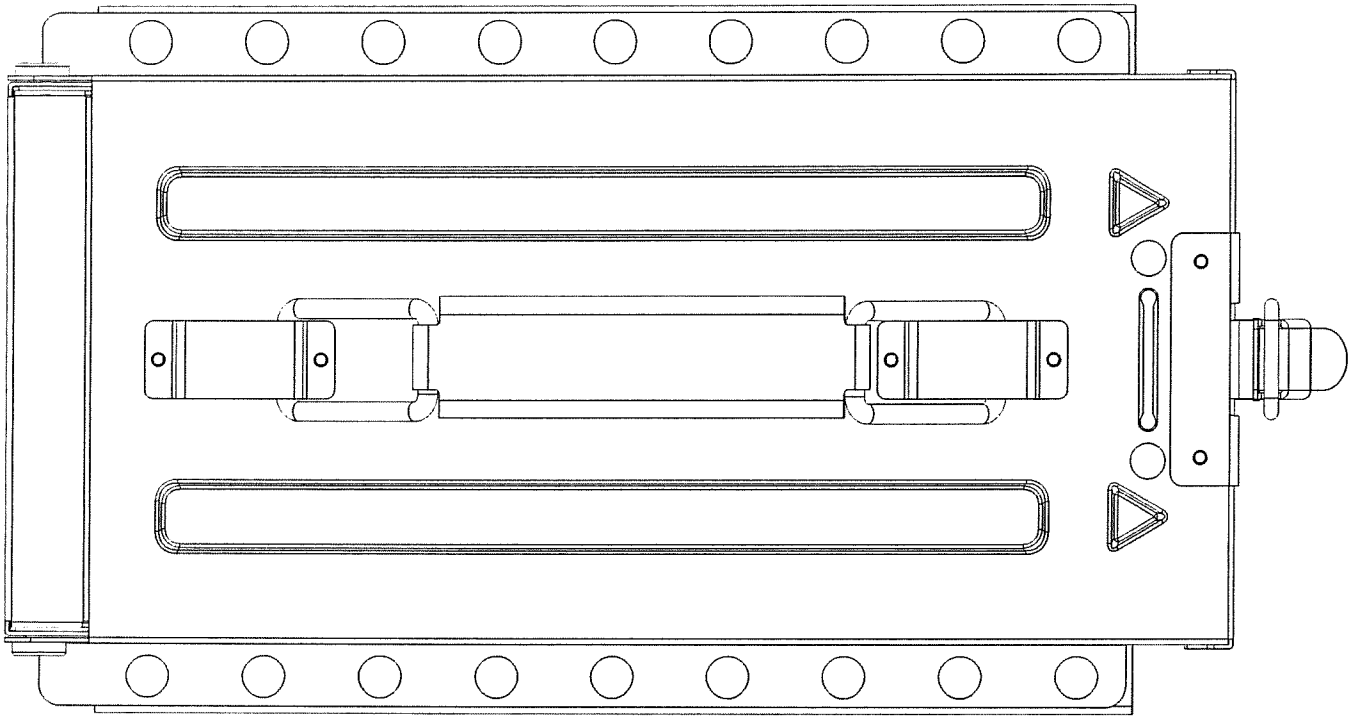
Figure 14H:
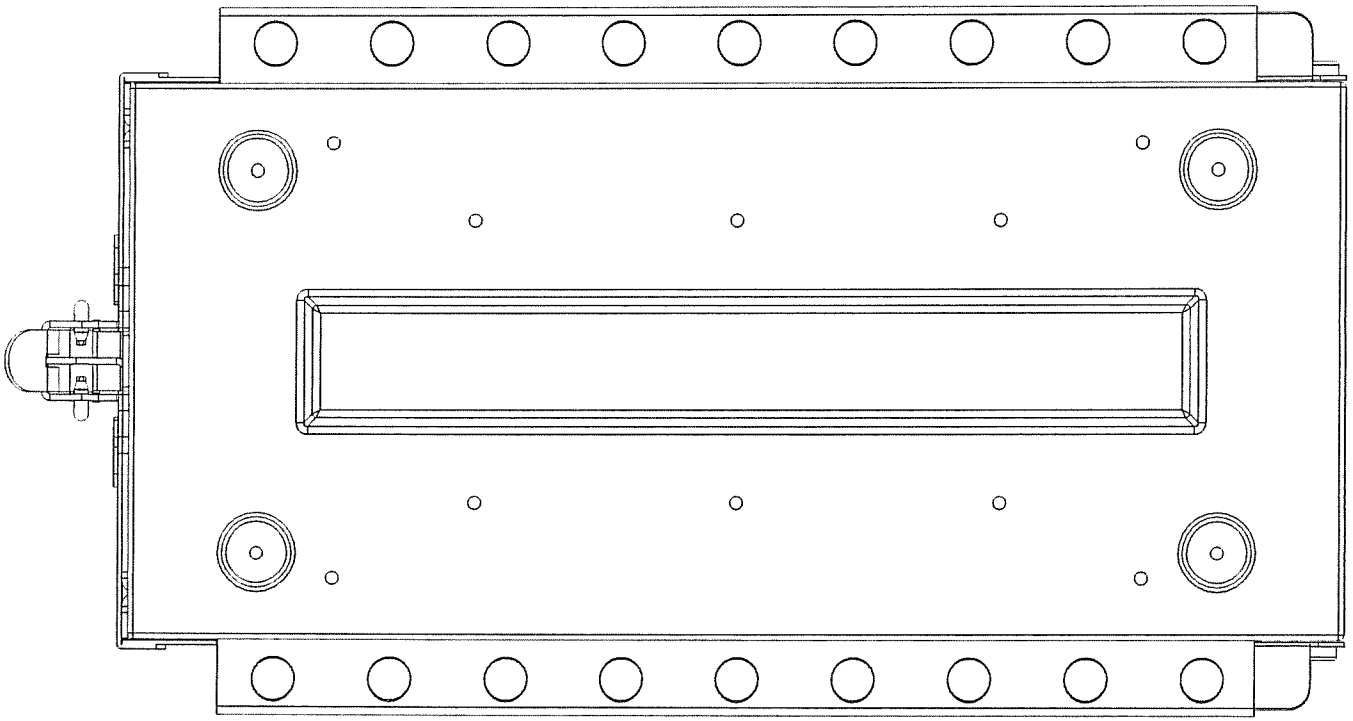
Figure 15A:
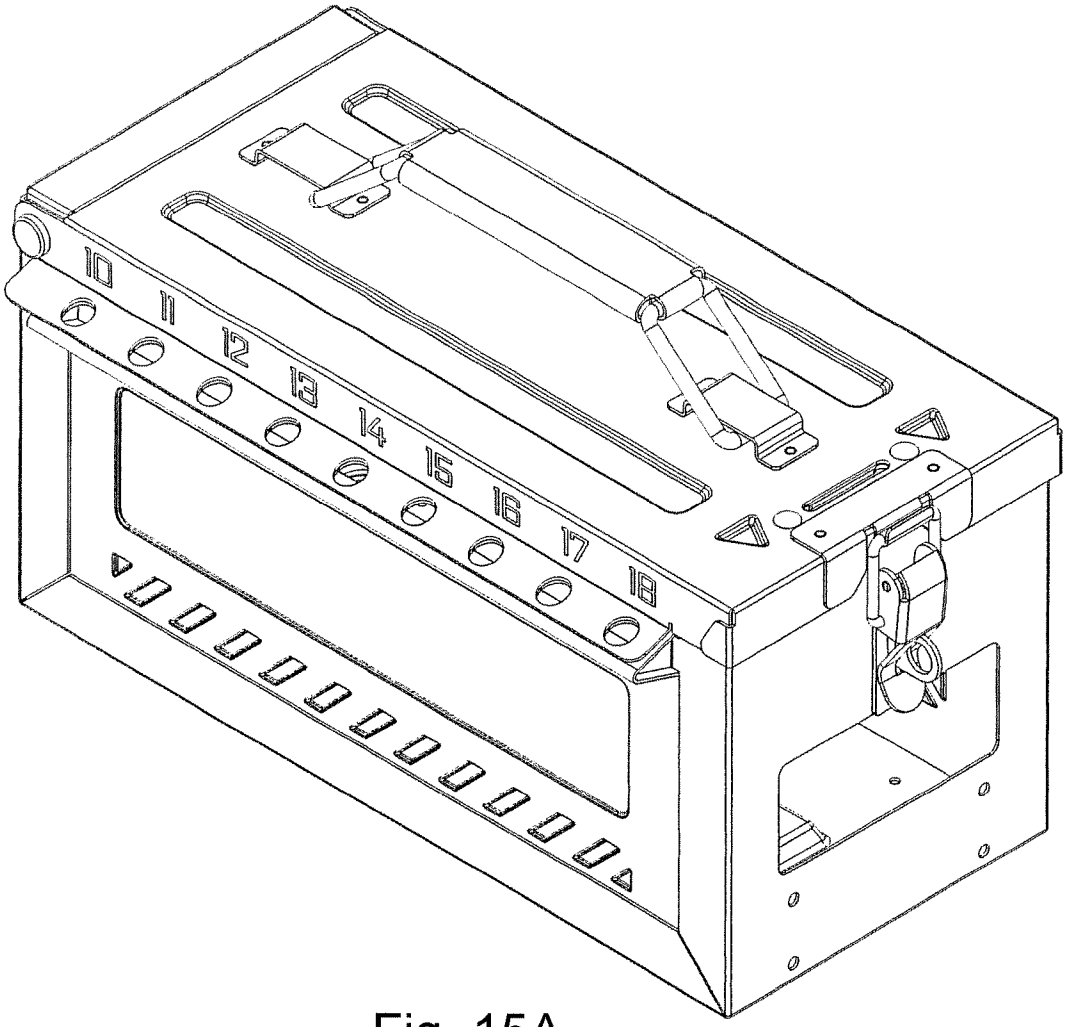
FIGS. 15A-15H illustrate top/left/front perspective, bottom/right/rear perspective, front elevational, rear elevational, left side elevational, right side elevational, top plan, and bottom plan views of another exemplary lockbox.
Figure 15B:
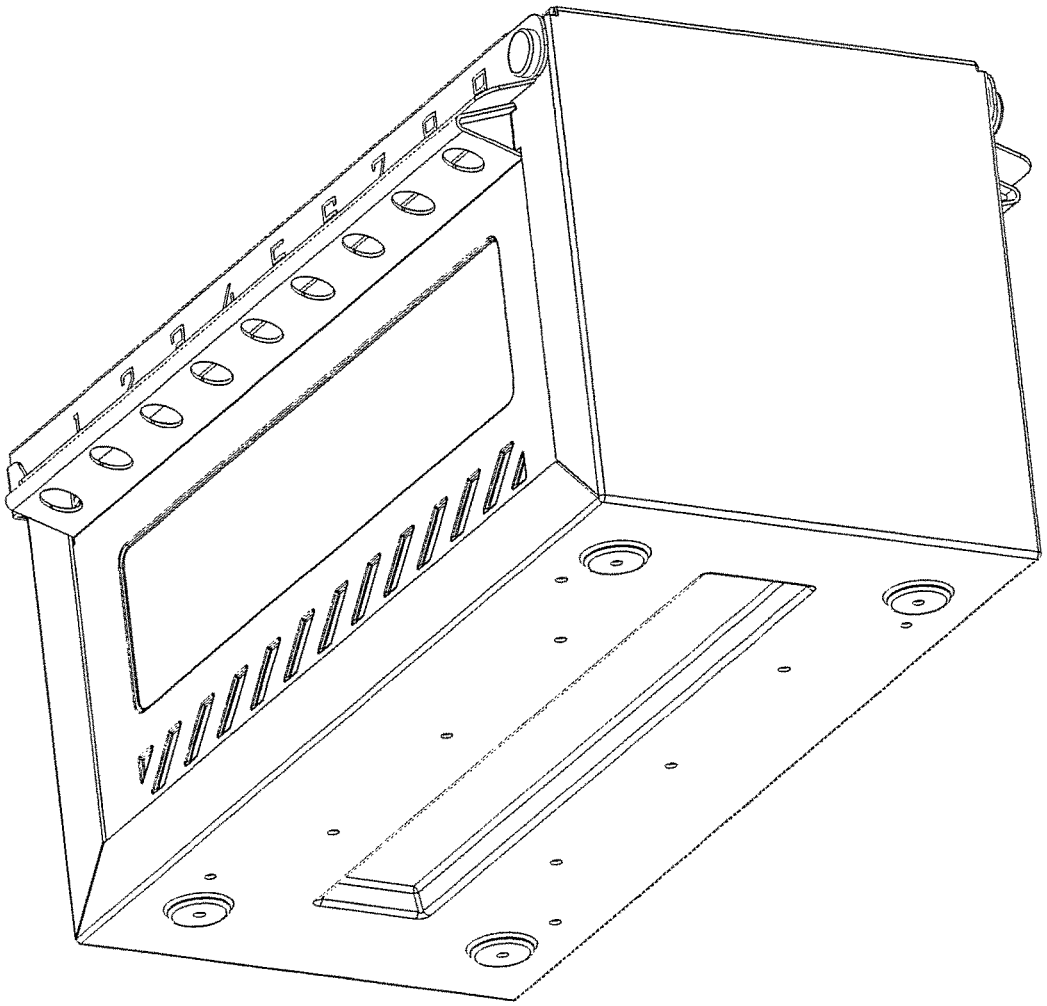
Figure 15C:
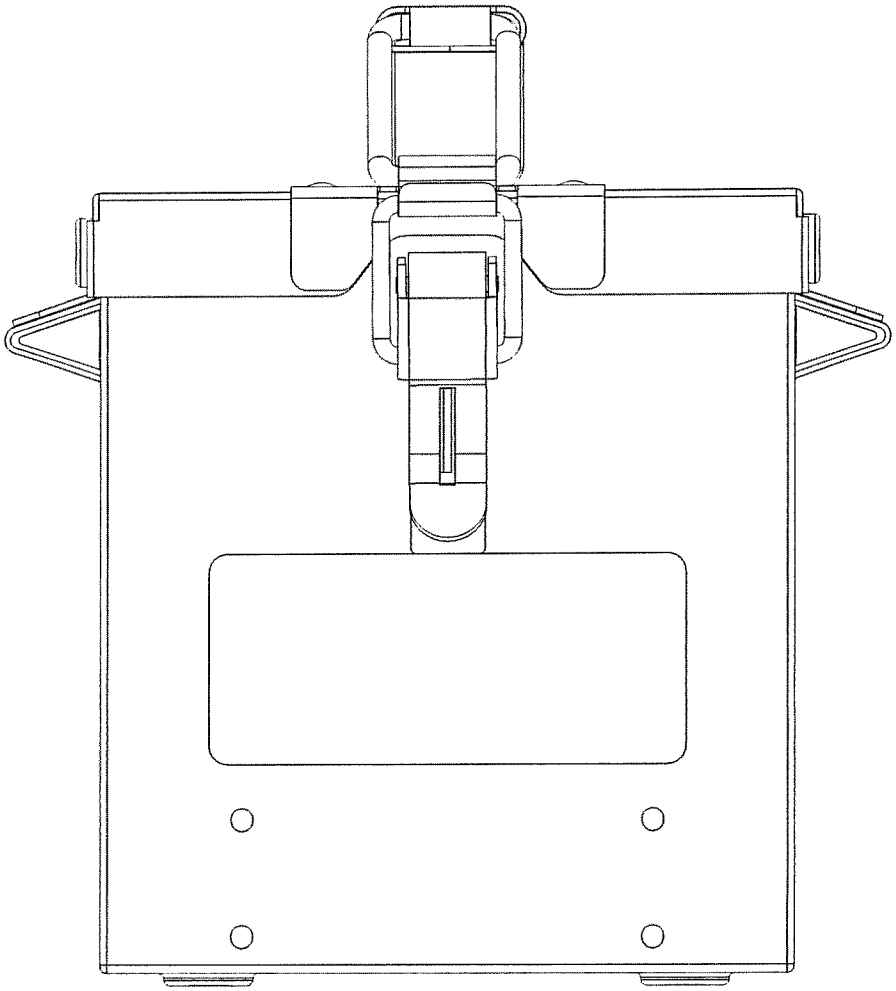
Figure 15D:
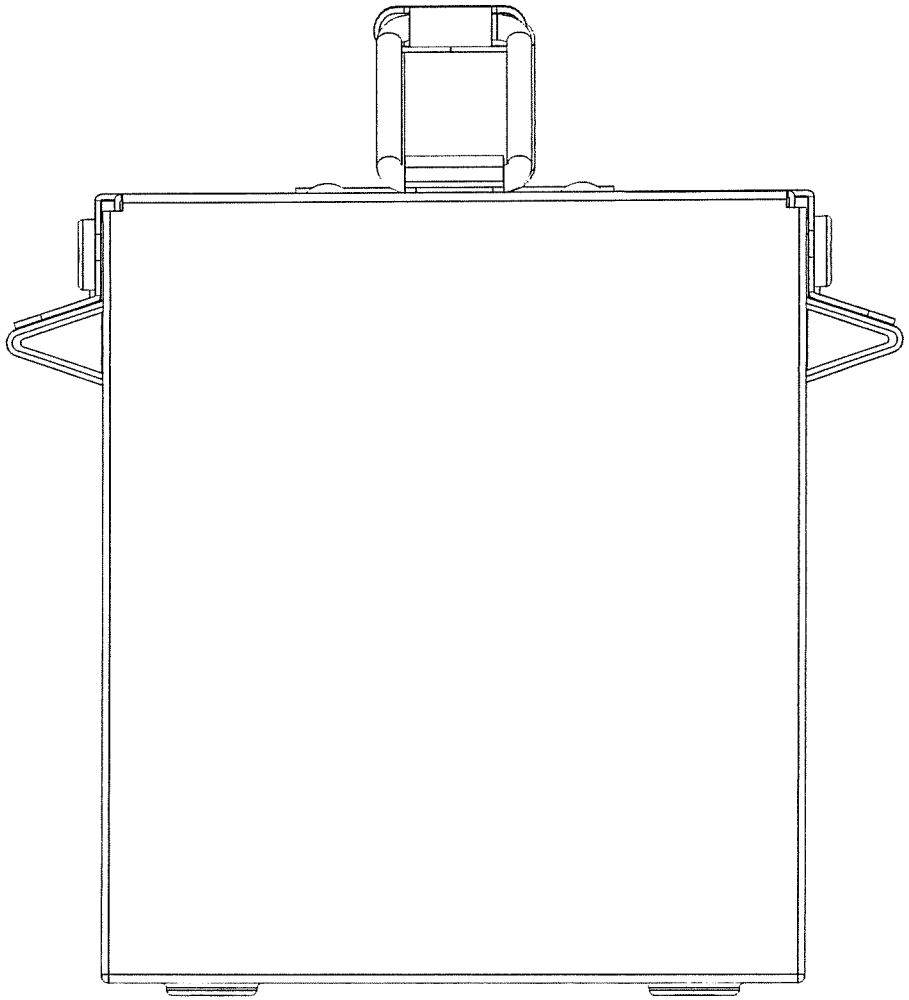
Figure 15E:
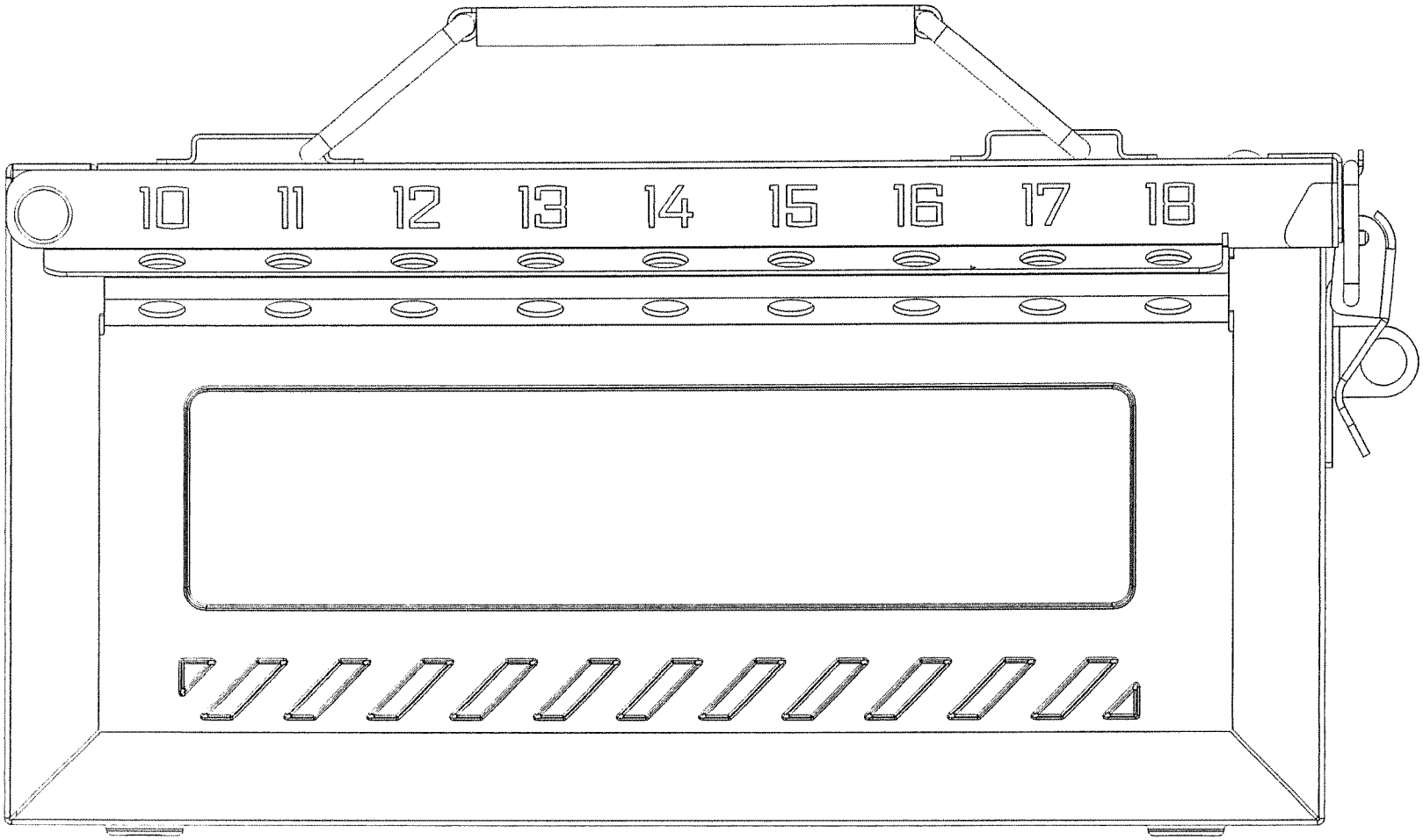
Figure 15F:
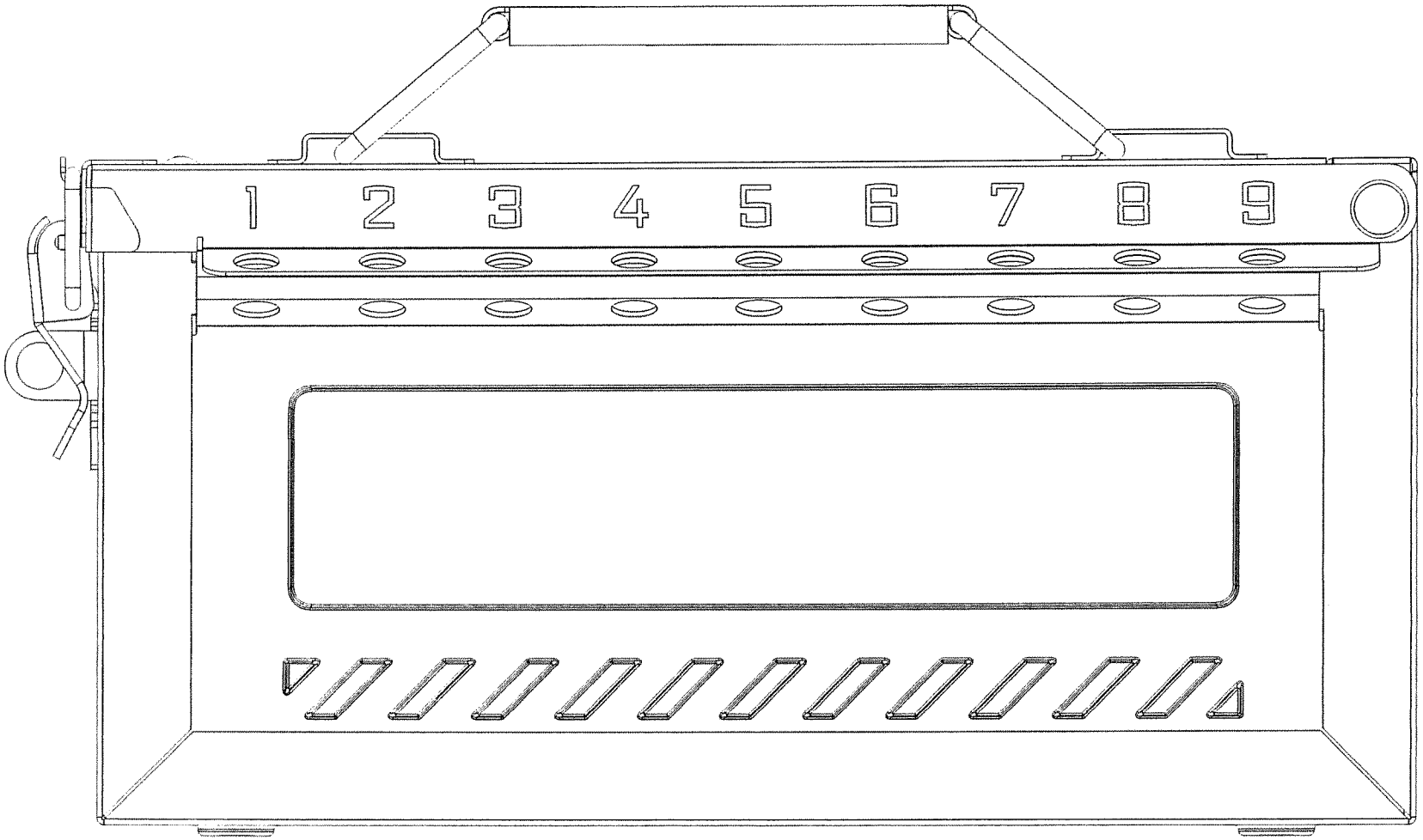
Figure 15G:
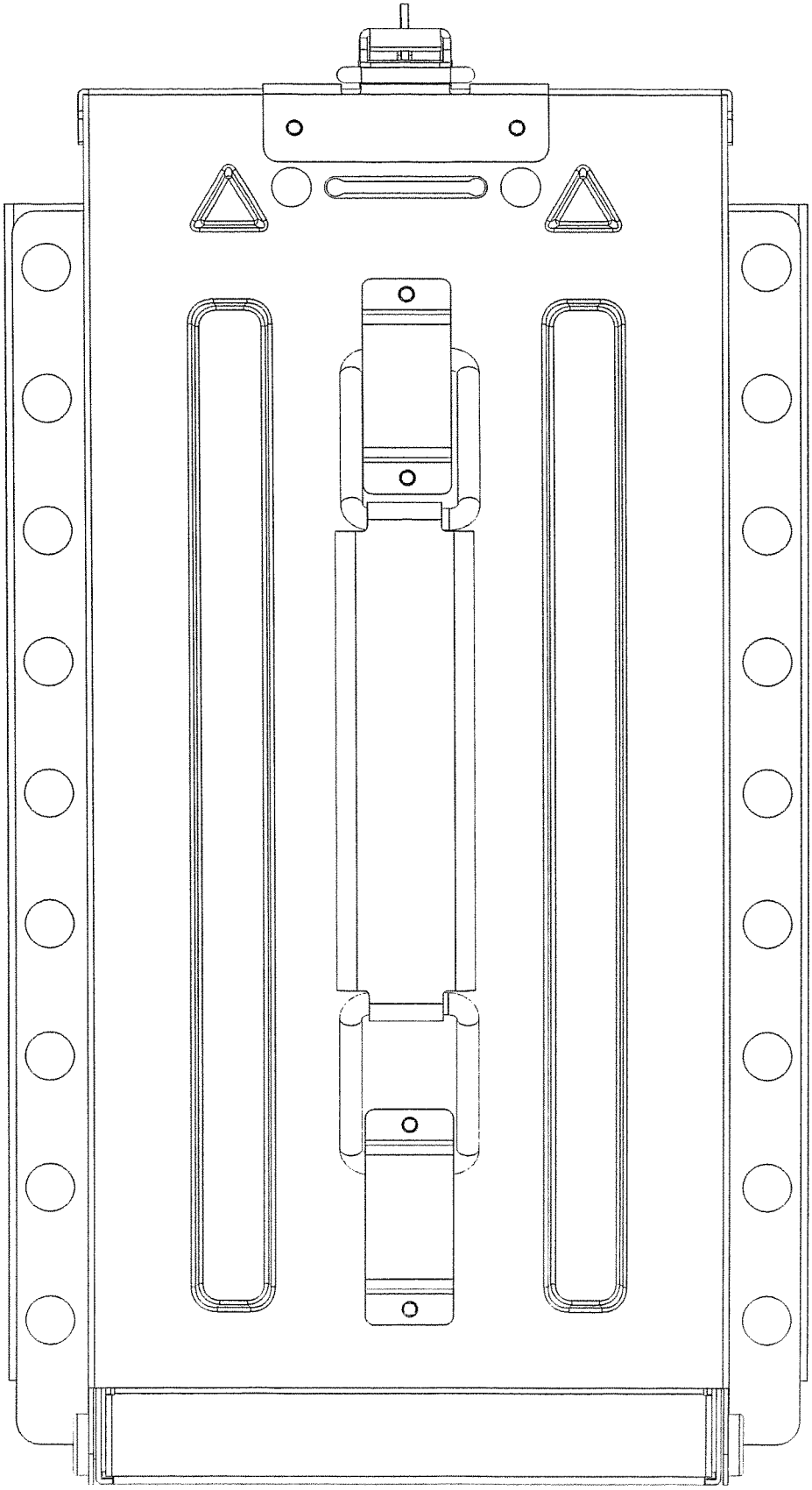
Figure 15H:
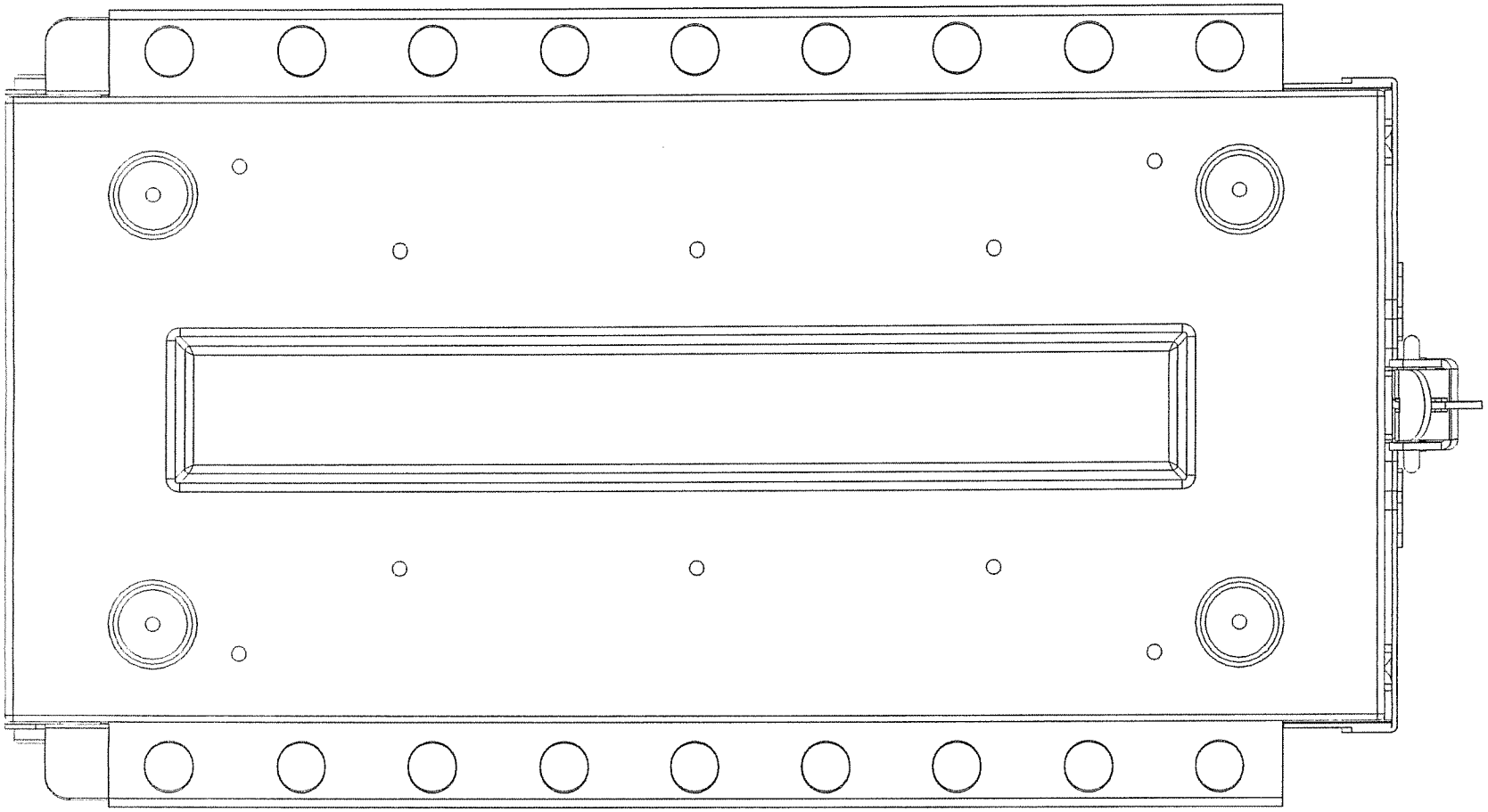
Figure 16A:
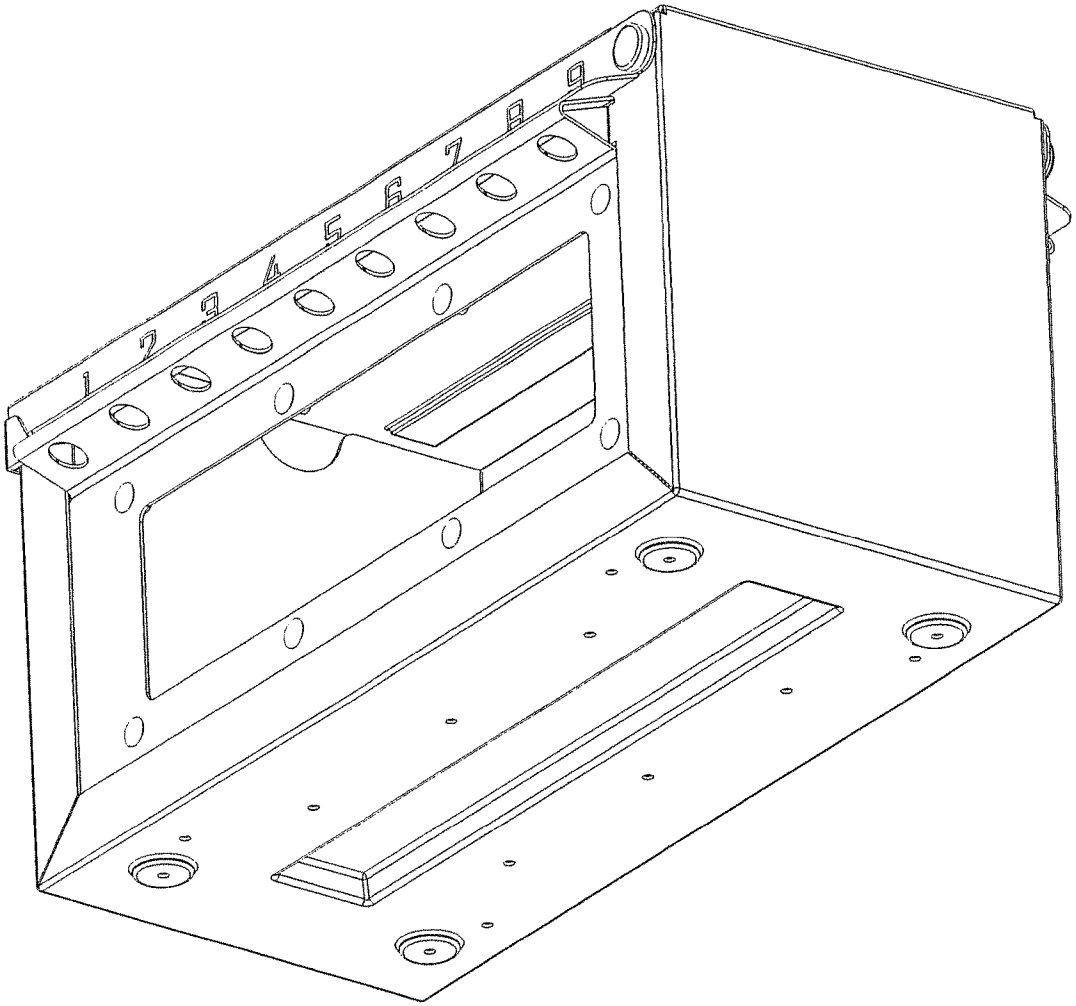
FIGS. 16A and 16B illustrate bottom/right/rear perspective and right side elevational views of another exemplary lockbox similar to the exemplary lockbox of FIGS. 15A-15H except having a window panel in the right side body wall.
Figure 16B:
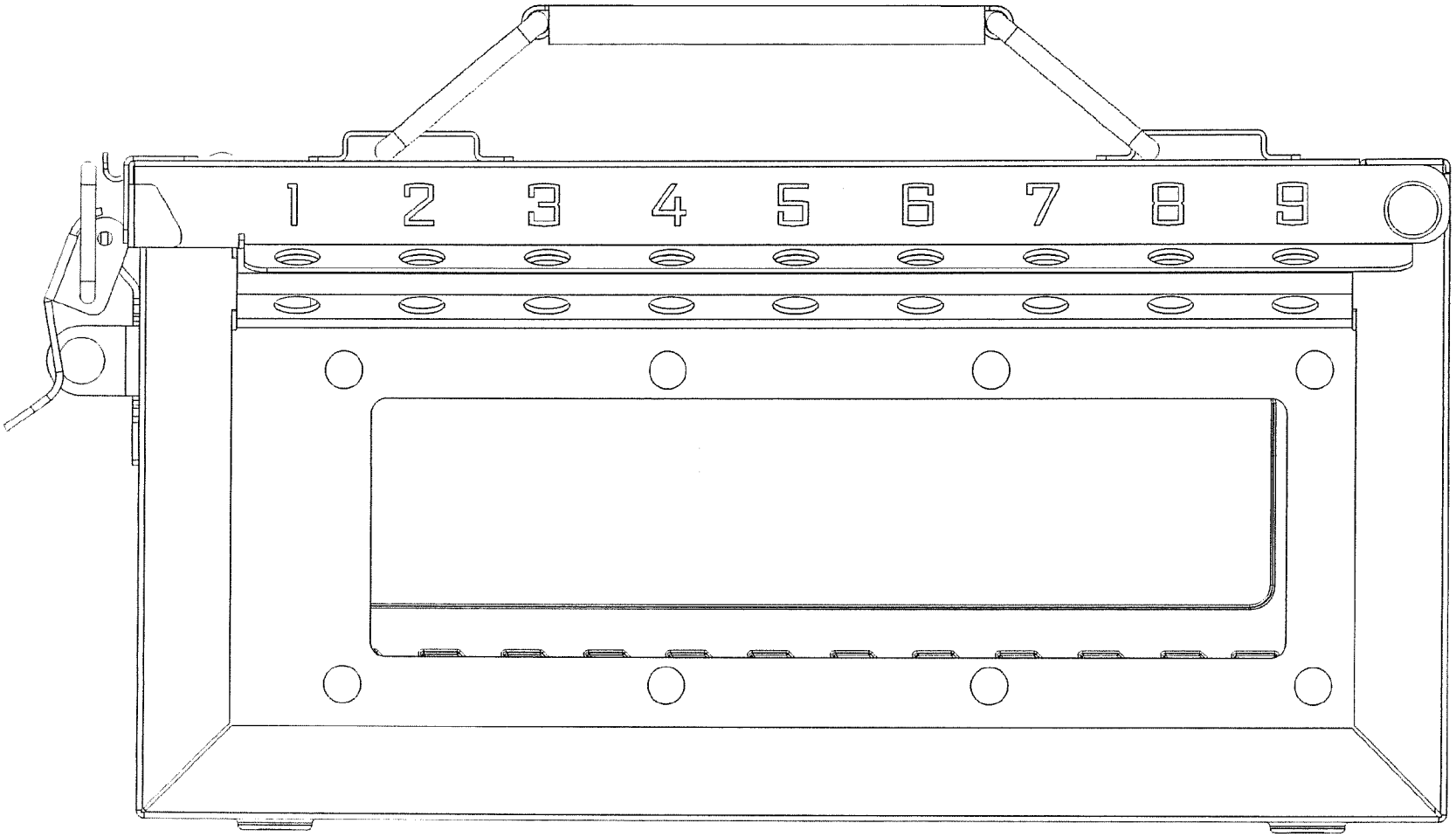

Other mechanisms may additionally or alternatively be utilized to hold the lid in the closed position when the lockbox is not locked out. FIGS. 12 and 13 illustrate another embodiment of a lockbox 200 with many features similar to the features of the lockbox 100 of FIGS. 1-11, but with the latching tab 126 and slot 136 replaced with a conventional buckle-type latch 260 attached to the front body wall 221*c*, and including a loop portion 263 that extends over a hook portion 261 secured to the lid front wall 231*c*, to latch the lid 230 with the body 220. A lever portion 264 of the buckle 260 is pivotable between a first position securing the loop portion 263 over the hook member 261, and a second position permitting disengagement of the loop portion 263 from the hook member 261. As shown, the buckle 260 further includes a hasp portion 265 that is received through a slot 266 in the lever portion 264 when the lever portion is in the first position. Insertion of a locking member (e.g., a shackle of a padlock) through a lockout aperture 267 in the hasp portion 265 secures the lever portion 264 in the first position to prevent disengagement of the loop portion 263 from the hook member 261. This front lock point may be used by a supervisor or primary operator, as the use of this lock point may provide the most visibility and may be most easily distinguishable from other lock point use. When the locking member is withdrawn from the lockout aperture 267, the lever portion 264 is pivotable to the second position to permit disengagement of the loop portion 263 from the hook member 261.

To provide additional secure retention of the lid in the closed position when the lockbox is not locked out (e.g., in case the buckle is not properly latched), the lid may be provided with one or more tabs (or other suitable interlocking features) that interlock with one or more slots (or other suitable interlocking features) in the lockbox body when the lid is in a closed and interlocked position, thereby preventing pivoting movement of the lid to the open position. In the illustrated embodiment of FIGS. 12 and 13, as shown in the side cross-sectional view of FIG. 13, the front wall 231*c* of the lid 230 is provided with inward or rearward extending latching tabs 236 that extend through aligned slots 226 in the front body wall 221*c* when the lid 230 is in the closed and interlocked position, thereby preventing pivoting movement of the lid 230 to the open position. To release the lid 230 for pivoting movement to the open position, the lid is slideable in a forward direction to disengage the slots 226 in the front body wall 221*c* from the latching tabs 236. While many different lid sliding mechanisms may be utilized, in the illustrated embodiment, similar to the embodiment of FIGS. 1-11, pivot pins 238, 239 are slideably secured in side slots 228, 229 disposed in the upper portions 222*a*, 222*b* of the left and right side body walls 221*a*, 221*b*. When one or more padlocks are secured through any of the aligned body and lid lock apertures 225*a*, 225*b*, 235*a*, 235*b*, and/or a padlock is secured through the buckle hasp 265, the lid 230 is blocked from sliding forward to the unlatched position.

Features may be provided to resist loose sliding movement of the lid from the latching position to the unlatched position. For example, as shown in the embodiment of FIGS. 1-11, a spring-loaded latch flap 156 may be provided on the lid above the latch slot 136. When the lid 130 is in the closed and latched position, the latch flap 156 is pivoted to an upward, spring-loaded position to permit insertion of the latching tab 126 through the slot 136. In this position, the latch flap 156 applies a downward force against the latching tab 126, to resist sliding movement of the lid 130 to the unlatched position when a padlock has not been installed through any of the lock apertures, thus preventing the lid 130 from opening, for example, when the lockbox 100 is being carried by the handle 140. As another example, shown in the embodiment of FIGS. 12 and 13, the latching tabs 236 may be provided with notched or ramped surfaces that engage the edges of the slots 226 to resist loose sliding movement of the lid 230.

Still other features may be additionally or alternatively provided with a lockbox in accordance with the present application. For example, as shown, the lockbox 100, 200 may be provided with a separate compartment or container 150, 250 positioned in the storage enclosure 123, 223 below a slot 151, 251 in the lid 130, 230 (when the lid is in the latched position), to receive and retain small items (e.g., padlock keys) inserted through the slot. The container 150, 250 may be attached to the front body wall 121*c*, 221*c* in any suitable manner. In the illustrated embodiments, a container retaining wall 170, 270 (FIGS. 11 and 13) is attached within the storage enclosure 123, 223 (e.g., by welding or fasteners) to form a cavity 171, 271 sized to receive the container 150, 250. The front body wall 121*c*, 221*c* may include a transparent panel 152, 252 to provide visibility of the contents of the container 150, 250 or storage enclosure 123, 223. A sleeve portion 153 may also be attached to the inside of the front body wall 121*c* (and may, for example, be integral with the container 150) to retain a card presenting identification, status, or other written information. A more permanent identification tag 154 may also be attached (e.g., by welding, rivets, or other fasteners) to the front body wall 121*c*.

FIGS. 14A-14H, 15A-15H, and 16A-16B illustrate various views of three exemplary lock box enclosures.

According to another aspect of the present application, a lockable enclosure is provided with a housing defining an internal cavity and an access door connected to a side wall of the housing at a hinge portion and pivotable about the hinge portion between open and closed positions to permit or restrict access to the internal cavity. While the housing and access door may be provided in many configurations, in one embodiment, a rear wall of the housing is mountable to an external structure (e.g., an interior or exterior building wall), and a lower edge portion of the access door is hingedly connected to a lower side wall of the housing, for downward and outward pivoting movement of the access door from the closed position to the open position. In other embodiments, the housing may remain detached from any external structure (e.g., as a portable lockbox) and/or the access door may be hingedly connected to another of the housing side walls (e.g., upper, left, or right side wall).

To selectively hold the access door in the closed position or permit pivoting movement of the access door to the open position, the access door may be slideable, along a longitudinal axis defined by the hinge portion, between an interlocking position in which an interlock portion of the access door engages a corresponding interlock portion of the housing to hold the access door in the closed position, and a release position in which the access door interlock portion disengages from the housing interlock portion to permit pivoting movement of the access door from the closed position to the open position.

Figure 17:
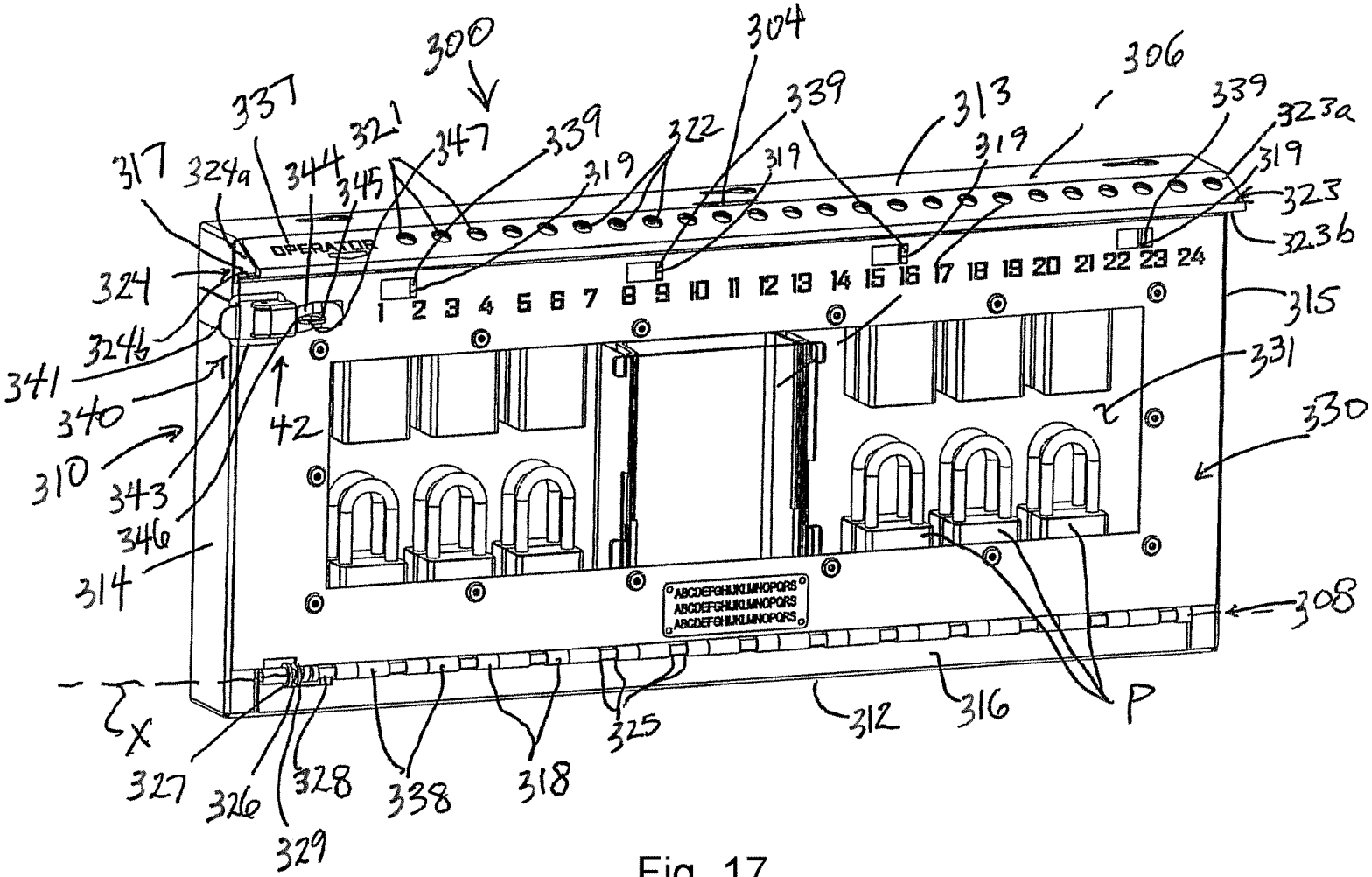
FIG. 17 illustrates a front perspective view of a lockable enclosure, in accordance with an exemplary embodiment, shown with the access door in a closed, interlocking position.
Figure 18:
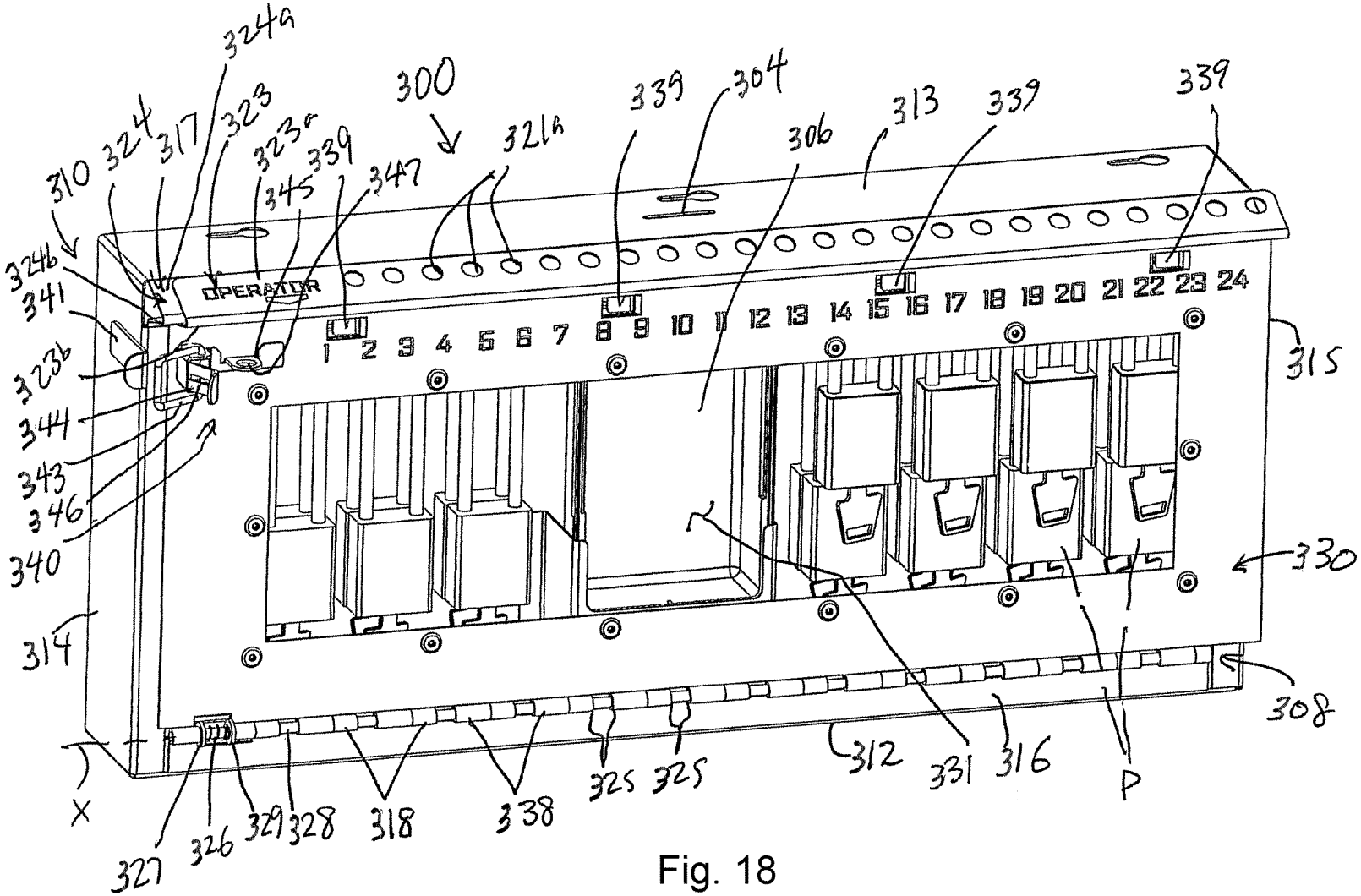
FIG. 18 illustrates a front perspective view of the lockable enclosure of FIG. 17, shown with the access door in a closed, release position.
Figure 19:
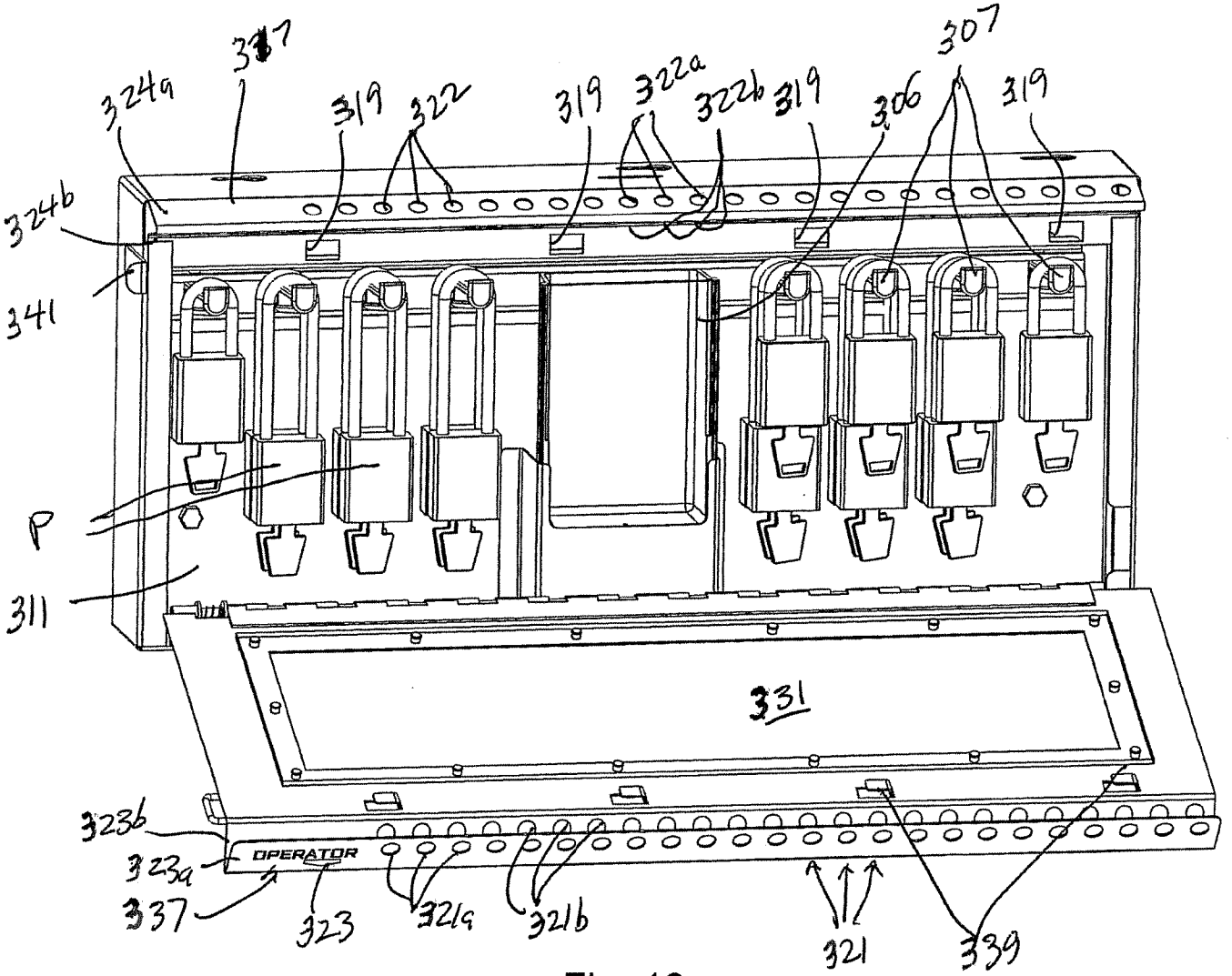
FIG. 19 illustrates a front perspective view of the lockable enclosure of FIG. 17, shown with the access door in an open position.

FIGS. 17-19 illustrate an exemplary lockable enclosure 300 including a housing 310 having a rear wall 311 and first (lower), second (upper), third (left) and fourth (right) side walls 312, 313, 314, 315 extending forward from the rear wall 311 to a front end to define a storage cavity 305 between the side walls. As shown in FIG. 19, the rear wall may include mounting holes to receive fasteners for mounting the rear wall to an external wall surface or other such structure. An access door 330 is hingedly connected to an upward extending flange portion 316 of the first, lower side wall 312 by a hinge 308 extending along a longitudinal axis X, for pivoting movement about the longitudinal axis X between a closed position (FIGS. 17 and 18) and an open position (FIG. 19). The exemplary hinge 308 includes a hinge portion 338 of the access door 330 that is connected with a housing hinge portion 318 on the lower wall flange portion 316 by a hinge pin 328 extending through the hinge portions 318, 338.

To hold the access door 330 in the closed position, the access door includes longitudinally extending tabs 339 that are received in, and interlock with, corresponding holes or slots 319 in a downward extending flange portion 317 of the second, upper side wall 313. To release the access door 330 for pivoting movement to the open position, the access door is slideable along the longitudinal axis X to a release position in which the tabs 339 fully align with the slots 319 to permit withdrawal of the tabs from the slots during pivoting movement of the access door to the open position. To permit longitudinal sliding movement of the access door 330, longitudinal gaps 325 are provided between the housing hinge portion 318 and the access door hinge portion 338, thereby permitting sliding movement of the access door hinge portion on the hinge pin 328.

According to another aspect of the present application, the access door may be securable in the closed, interlocking position by one or more locking features. While the locking feature or features may include a variety of elements and mechanisms, in one embodiment, one or more lockout apertures are provided on at least one of the access door and the housing, such that insertion of a locking member (e.g., a padlock shackle) through one of the one or more lockout apertures prevents sliding movement of the access door from the interlocking position to the release position. In the illustrated embodiment of FIGS. 17-19, a series of door lockout apertures 321 are disposed on an end portion 337 of the access door 330, opposite the hinge portion 338. The door lockout apertures 321 align with a corresponding series of housing lockout apertures 322, disposed on the upper wall flange portion 317, when the access door 330 is in the closed, interlocking position, as shown in FIG. 17.

Figure 17A:
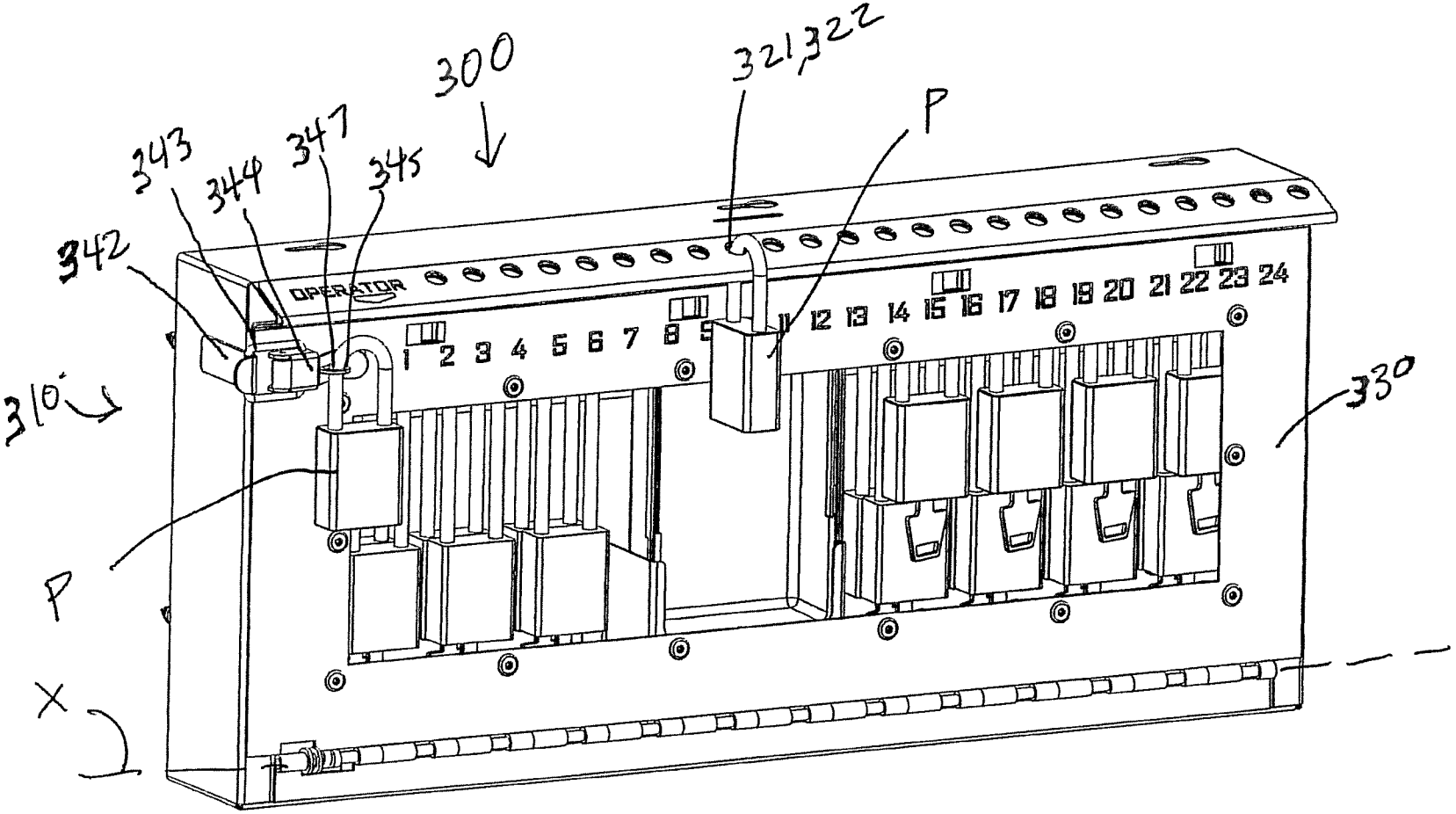
FIG. 17A illustrates a front perspective view of the lockable enclosure of FIG. 17, in accordance with an exemplary embodiment, shown with padlocks securing the access door in the closed, interlocking position.

In the illustrated example, the end portion 337 of the access door 330 includes a V-shaped rail portion 323 having upper and lower lateral portions 323*a*, 323*b* having a series of upper and lower holes 321*a*, 321*b* that align to define the door lockout apertures 321. The upper wall flange portion 317 of the housing 310 includes a V-shaped rail portion 324 having upper and lower lateral portions 324*a*, 324*b* with a series of upper and lower holes 322*a*, 322*b* that align to define the housing lockout apertures 322. When the access door 330 is in the closed, interlocking position, the housing rail portion 324 is received between the upper and lower lateral portions 323*a*, 323*b* of the door rail portion 323 for alignment of the housing lockout apertures 322 with the door lockout apertures 321. When a locking member (e.g., a padlock shackle) is inserted through an aligned pair of door and housing lockout apertures 321, 322, as shown in FIG. 17A, sliding movement of the access door 330 along the longitudinal axis X to the release position (FIG. 18) is prevented. These aligned pairs of lockout apertures 321, 322 may be identified by indicia (e.g., numbers) engraved or otherwise marked on the enclosure (e.g., on the housing upper wall, or on the access door, as shown).

As shown, a latch mechanism may be provided, in addition to or instead of the pairs of door and housing lockout apertures, to secure the access door in the closed, interlocking position. In one embodiment, a latch mechanism is operable to latch the access door with a side wall (e.g., the left side wall) of the housing when the access door is in the closed and interlocking position. While many different types of latch mechanisms may be utilized, in the illustrated embodiment, the latch mechanism 340 includes a hook member 341 affixed (e.g., fastened, welded) to the third or left side wall 314, and a buckle 342 affixed to the access door 330 for latching engagement with the hook member 341. In the illustrated embodiment, the buckle 342 includes a loop portion 343 that extends over the hook member 341 to latch the access door 330 with the left side wall 314, thereby holding the access door in the closed and interlocking position. A lever portion 344 of the buckle 342 is pivotable between a first position (FIG. 17) securing the loop portion 343 over the hook member 341, and a second position (FIG. 18) permitting disengagement of the loop portion 343 from the hook member 341. As shown, the buckle 342 further includes a hasp portion 345 that is received through a slot 346 in the lever portion 344 when the lever portion is in the first position. Insertion of a locking member (e.g., a shackle of a padlock P) through a lockout aperture 347 in the hasp portion 345, as shown in FIG. 17A, secures the lever portion 344 in the first position to prevent movement of the access door 330 to the release position. When the locking member is withdrawn from the lockout aperture 347, the lever portion 344 is pivotable to the second position to permit disengagement of the loop portion 343 from the hook member 341 and sliding movement of the access door 330 along the longitudinal axis X to the release position.

When any and all locking members are withdrawn from the aligned pairs of lockout apertures 321, 322 and the buckle hasp lockout aperture 347 (in combination with disengagement of the loop portion 343 from the hook member 341), the access door 330 is slideable from the interlocking position to the release position. While the access door may be configured for selective manual sliding movement to the release position (e.g., by a user-applied force in the longitudinal direction), in one embodiment, the access door may be spring loaded by a spring biasing mechanism for automatic sliding of the access door along the longitudinal axis to the release position. In the illustrated embodiment, a compression spring member 326 extends around the hinge pin 328 to apply an axial outward biasing force between the housing hinge portion 318 and the access door hinge portion 338. To apply a more uniform biasing force, the spring member 326 may be disposed between washers 327, 329 disposed on the hinge pin 328.

To return the closed access door 330 to the interlocking position, the loop portion 343 of the buckle 342 is extended over the hook member 341, and the lever portion 344 is pivoted from the second position to the first position. This pivoting movement of the lever portion 344 causes the access door 330 to be axially pulled against the biasing force of the spring member 326 and back to the interlocking position.

Figure 20:
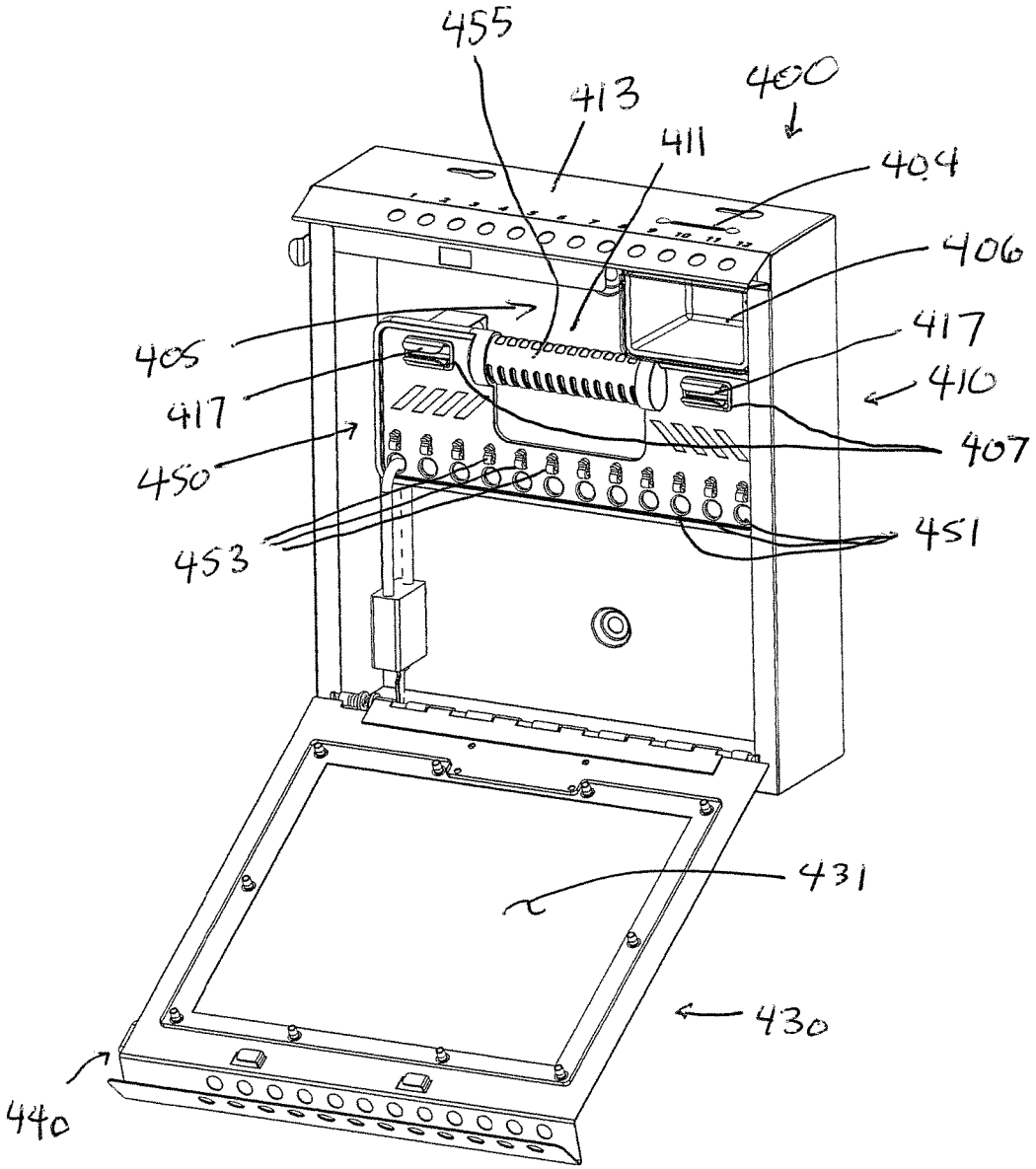
FIG. 20 illustrates a front perspective view of another lockable enclosure, in accordance with another exemplary embodiment, shown with the access door in an open position.

A lockable enclosure in accordance with the present application may be provided in a variety of sizes. FIG. 20 illustrates another exemplary lockable enclosure 400 including a housing 410, access door 430, and latch mechanism 440 similar to those of the lockable enclosure 300 of FIGS. 17-19, except with a reduced width, for example, to accommodate smaller spaces and/or lockout systems requiring fewer padlocks.

A locking enclosure as described herein may additionally or alternatively be provided with other features. For example, the upper side wall 313, 413 of the housing 310, 410 may include a slot 304, 404 for receiving smaller items, such as, for example, keys. These smaller items may be received and retained in a separate cup portion 306, 406 secured within the storage cavity 305, 405, and, like a central panel portion 331, 431 of the access door 330, 430, may be transparent for viewing of the contents of the cup portion 306, 406.

To uniformly retain padlocks or other items within the storage cavity, as shown in the embodiment of FIGS. 17-19, a series of hanging posts 307 may be affixed to the rear wall 311 of the housing 310 to hang or otherwise support padlocks P or other items within the storage cavity 305. Alternatively, as shown in the embodiment of FIG. 20, a separate padlock retainer or carrier 450 may be secured within the storage cavity 405 to removably retain multiple padlocks, for example, to facilitate transporting of a plurality of padlocks P to the lockable enclosure 400. As shown, the padlock carrier 450 may be provided with a series of apertures 451 through which multiple padlocks may be secured. The padlock carrier 450 may be secured within the storage cavity using any suitable arrangement. In the exemplary embodiment, the lockable enclosure 400 includes outwardly biased flexible clips 407 attached to the rear wall 411 of the housing 410, and insertable through complementary shaped mounting holes 457 in the carrier 450 to hold the carrier in place within the housing 410. The carrier may additionally be provided with a series of retention clips 453 aligned with the apertures 451 for retaining a key, lockout tag, or other accessory associated with the padlock secured to the corresponding aperture 451. The carrier 450 may be provided with a molded handle 455 to facilitate user carrying of the carrier.

According to another aspect of the present application, a document display apparatus is provided, independently or in combination with a lockable enclosure (e.g., the lockable enclosures 300, 400 of FIGS. 17 and 20 as described above), for example, to display permits, work orders, or other documents relevant to a safety lockout procedure. In one such embodiment, a document display apparatus is provided with a wall mountable substrate and at least one document retaining frame hingedly connected to the wall mountable substrate for pivoting movement of the document retaining frame between a document display position in which a rear surface of the at least one document retaining frame abuts the wall mountable substrate, and a document access position in which the rear surface of the document retaining frame is exposed, for example, for removal or replacement of a document secured to the document retaining frame. A document mounting feature is connected with the at least one document retaining frame, and is configured to releasably secure a document to the rear surface of the document retaining frame, against a transparent central portion of the document retaining frame. A frame attachment feature is assembled with one of the wall mountable substrate and the at least one document retaining frame, and is movable between a frame securing position securing a side wall portion of the at least one document retaining frame to the wall mountable substrate, and a frame releasing position permitting pivoting move ment of the at least one document retaining frame from the document display position to the document access position.

Figure 21:
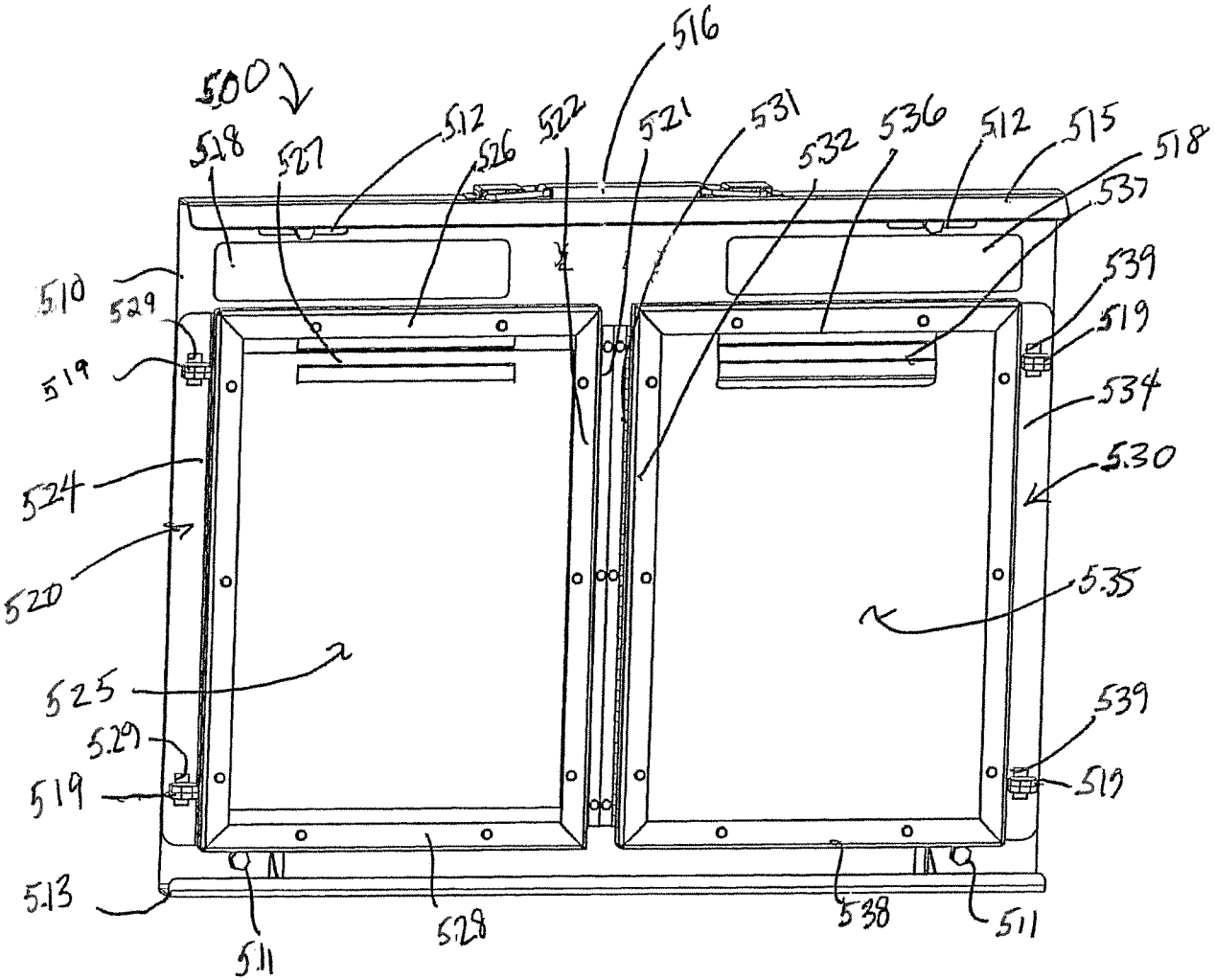
FIG. 21 is a front perspective view of a document display apparatus, shown with the document retaining frames in the display position.
Figure 22:
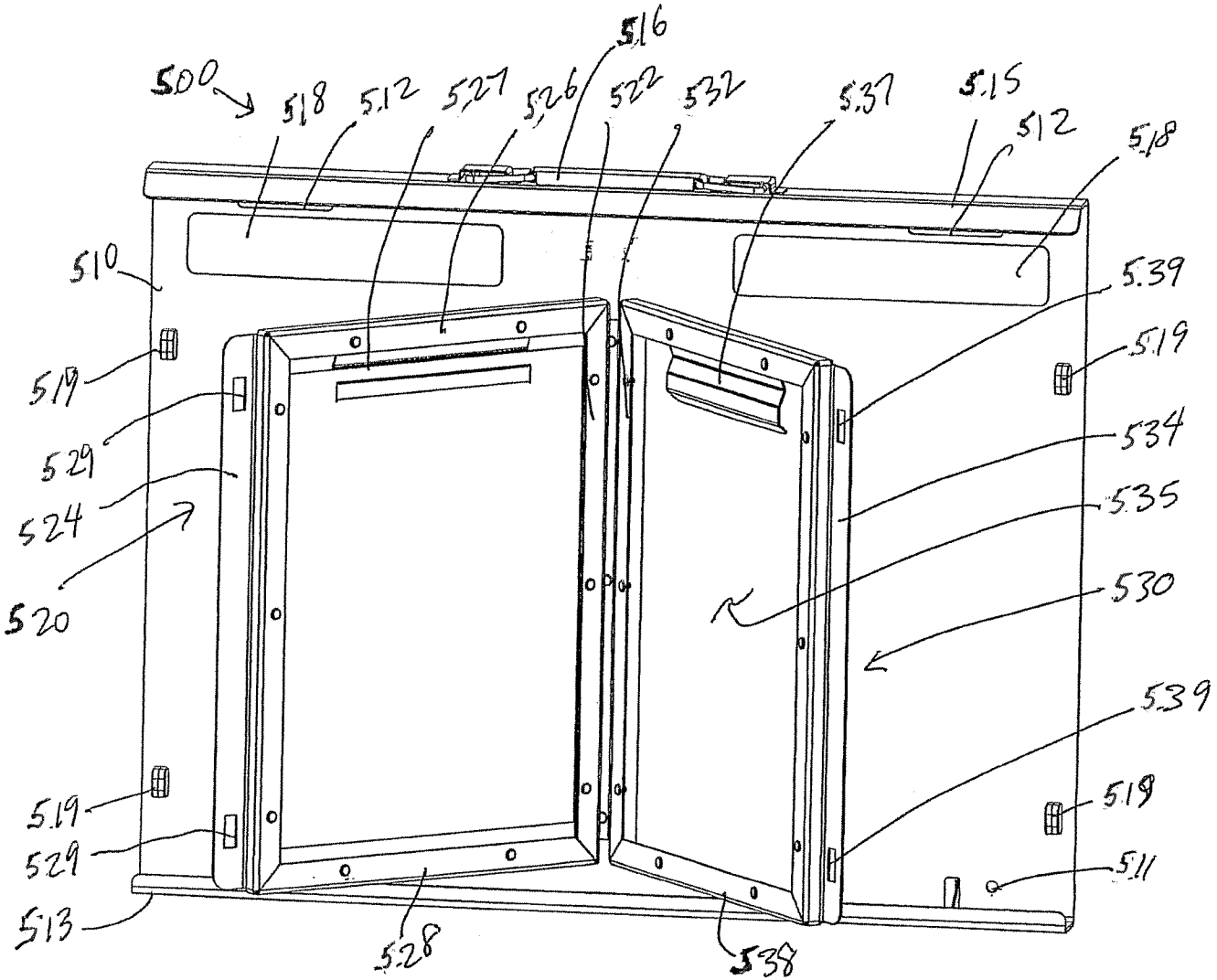
FIG. 22 is a front perspective view of the document display apparatus of FIG. 21, shown with the document retaining frames in the access position.
Figure 24:
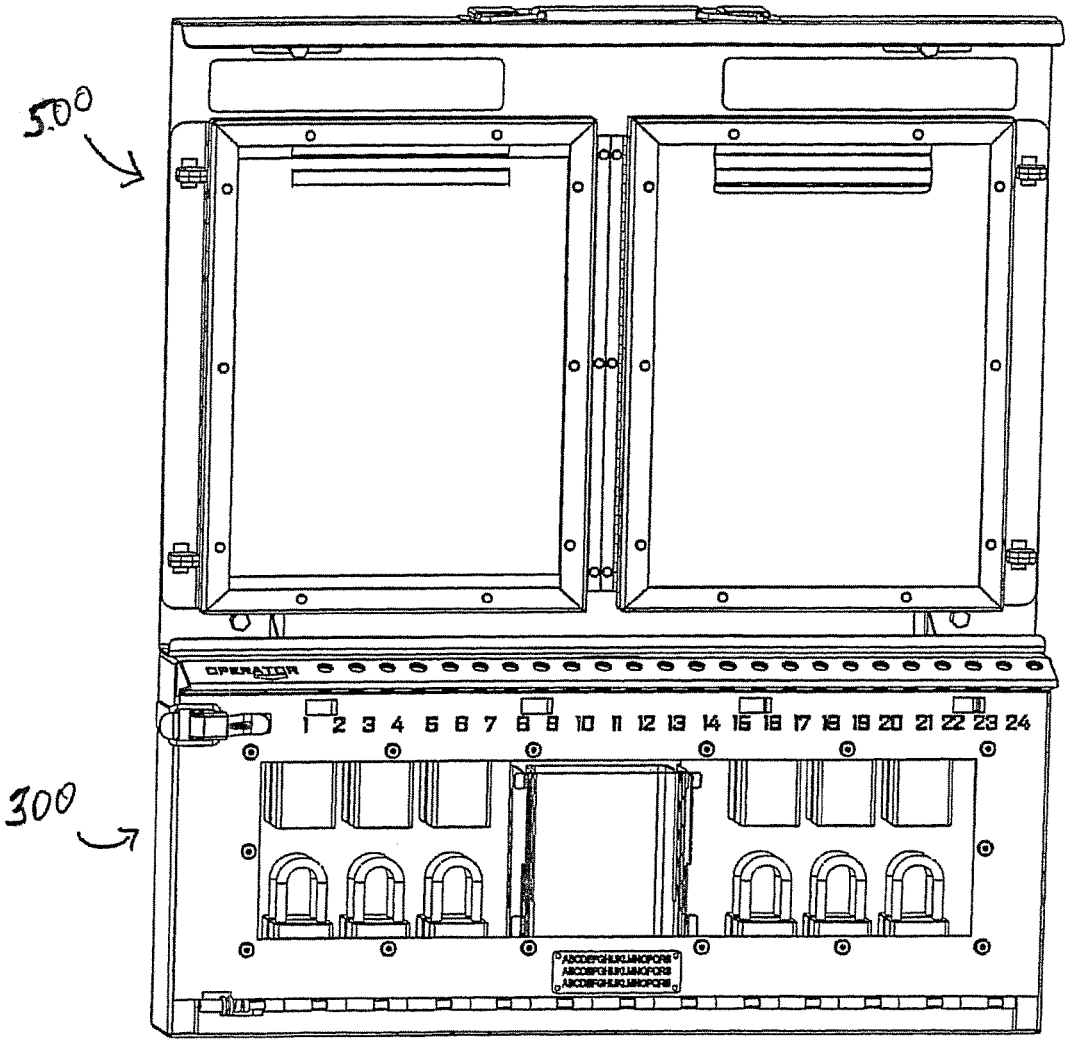
FIG. 24 is a front perspective view of a permit station, in accordance with an exemplary embodiment, including the lockable enclosure of FIG. 17 and the document display apparatus of FIG. 21.

FIGS. 21 and 22 illustrate an exemplary document display apparatus 500 including a wall mountable substrate 510 having lower mounting holes 511 and upper mounting slots 512 for mounting the substrate 510 to an external wall surface. The substrate 510 may include a forward extending bottom flange portion 513 for mounting to a second wall mounted apparatus, such as, for example, the lockable enclosure 300 of FIGS. 17-19 (as shown in FIG. 24), or a second document display apparatus 500. First and second document retaining frames 520, 530 are hingedly connected to the wall mountable substrate 510 at hinges 521, 531 disposed along adjacent first side wall portions 522, 532 of the document retaining frames. The document retaining frames are pivotable about these hinges 521, 531 between a document display position (FIG. 21) in which rear surfaces 523, 533 of the document retaining frames abut the wall mountable substrate 510, and a document access position (FIG. 22), in which the rear surfaces of the document retaining frames are exposed, for example, for removal or replacement of documents secured to the document retaining frames. The document retaining frames include central transparent panels 525, 535 (e.g., glass, plastic) surrounded by first (inner lateral), second (outer lateral), third (upper), and fourth (lower) side wall portions 522, 532, 524, 534, 526, 536, 528, 538.

Figure 23:
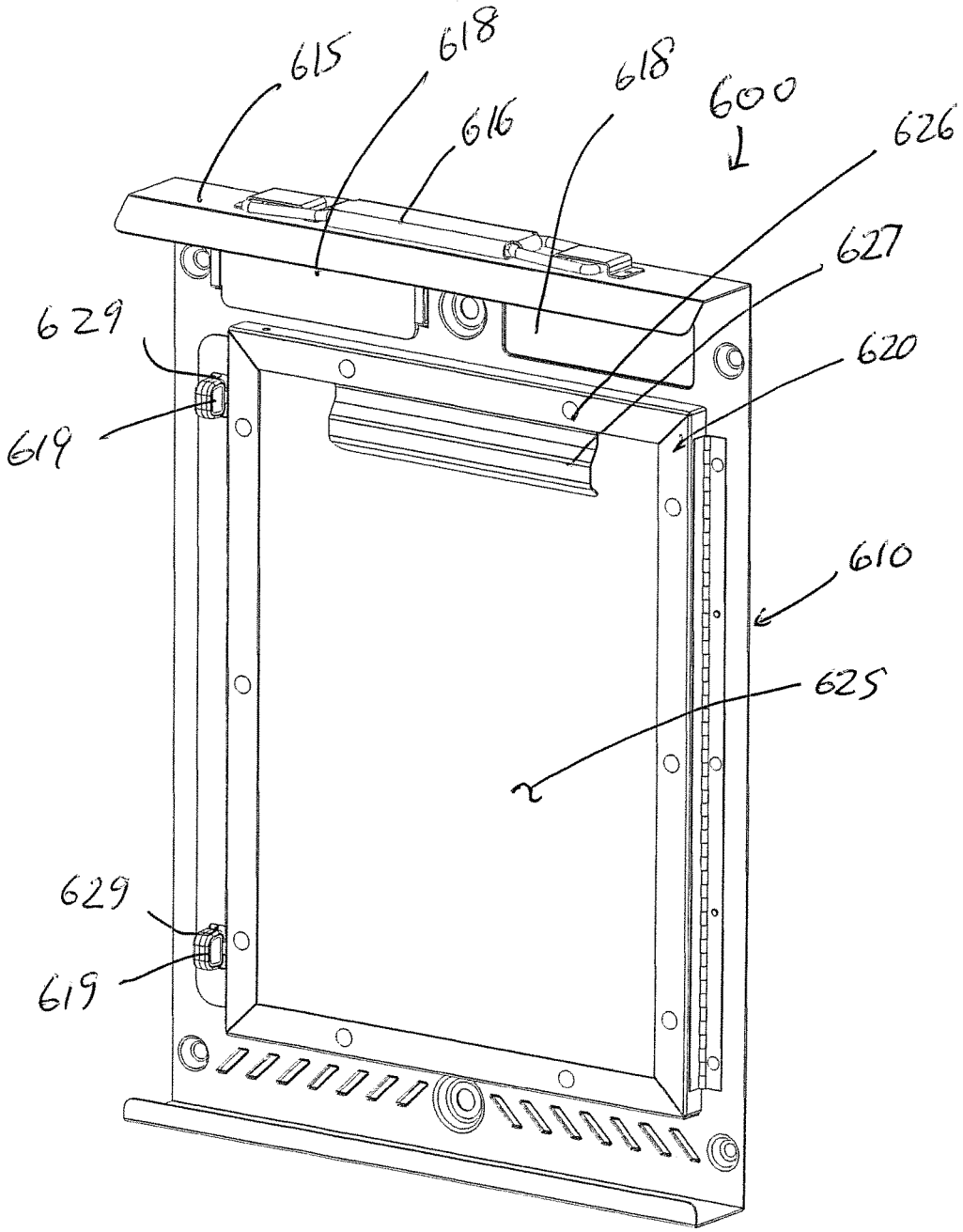
FIG. 23 is a front perspective view of another document display apparatus, shown with the document retaining frame in the display position.
Figure 25:
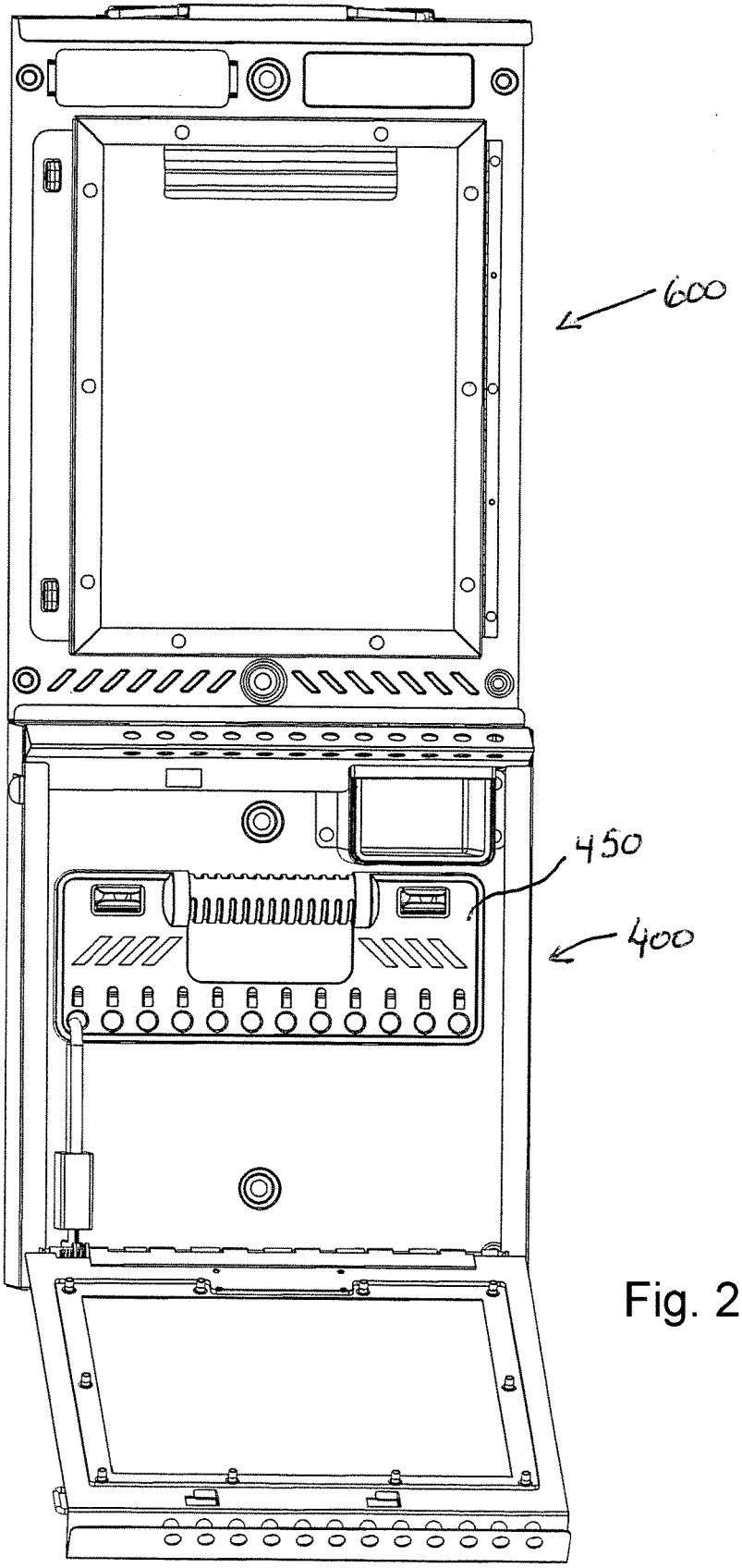
FIG. 25 is a front perspective view of another permit station, in accordance with another exemplary embodiment, including the lockable enclosure of FIG. 20 and the document display apparatus of FIG. 23.

A document display apparatus, in accordance with the present application, may include any number of document retaining frames. FIG. 23 illustrates another exemplary document display apparatus 600 including a wall mountable substrate 610 similar to the substrate 510 of the apparatus 500 of FIGS. 21 and 22, except sized to accommodate a single document retaining frame 620 hingedly connected to the substrate 610, for example, for mounting to a reduced width lockable enclosure, such as, for example, the lockable enclosure 400 of FIG. 20 (as shown in FIG. 25).

The document retaining frames 520, 530, 620 may be provided with one or more document mounting features (e.g., clips, fasteners, adhesive, magnets) to secure a document against a rear surface of the central transparent panels 525, 535, 625. In the illustrated embodiments, a flexible clip portion 527, 537, 627 is attached to the upper wall portion 526, 536, 626 to secure a document against the rear surfaces.

The document retaining frames 520, 530, 620 may be provided with one or more frame attachment features (e.g., clips, fasteners, tabs, knobs, detents) assembled with one of the wall mountable substrate 510, 610 and the document retaining frames 520, 530, 620 with the frame attachment features being movable between a frame securing position securing a side wall portion of the at least one document retaining frame to the wall mountable substrate, and a frame releasing position permitting pivoting movement of the at least one document retaining frame from the document display position to the document access position. In the illustrated embodiments, pivotable eccentric knobs 519, 619 are connected to the wall mountable substrate 510, 610 and are receivable through complementary shaped slots 529, 539, 629 in the document retaining frames 520, 530, 620. In a frame securing position, the knobs 519, 619 are misaligned with the slots 529, 539, 629 to block pivoting movement of the document retaining frames 520, 530, 620 from the document display position. In a frame releasing position, the knobs 519, 619 are aligned with the slots 529, 539, 629 to permit pivoting movement of the document retaining frames 520, 530, 620 from the document display position to the document access position.

A document display apparatus as described herein may additionally or alternatively be provided with other features. For example, a handle portion 516, 616 may be attached to a forward extending upper flange portion 515, 615, for example, to carry the document display apparatus 500, 600 (and, if so attached, an attached lockable enclosure 300, 400) to another location. Tags or labels 518, 618 (e.g., rewritable tags) may be provided on the mountable substrate 510, 610, above the document retaining frames 520, 530, 620 for example, to identify the types of documents to be retained.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

We claim:

1. A lockable enclosure for secure storage of one or more items, the lockable enclosure comprising:

a lockbox body including first, second, third, and fourth side body walls each extending forward from a bottom wall to an outer end to define a storage cavity therebetween; and a lid having a hinge portion connected with the first side body wall and including front, left and right side lid walls extending downward from a top lid wall to a lower edge to overhang upper portions of the second, third and fourth side body walls when the lid is in the closed position, the lid being pivotable about a longitudinal axis of the hinge portion between a closed position blocking access to the cavity and an open position permitting access to the cavity;

wherein the lid includes a first lid flange extending laterally outward from one of the left and right side lid walls, and the body includes a corresponding first body flange extending laterally outward from an outer end of a corresponding one of the second and third side body walls, wherein when the lid is in the closed position, a first lid lock aperture in the first lid flange aligns with a first body lock aperture in the first body flange, such that insertion of a padlock shackle through the first lid lock aperture and the first body lock aperture prevents movement of the lid with respect to the body; and wherein the first lid flange is offset from the top lid wall by a distance greater than a diameter of the first lid lock aperture.

2. The lockable enclosure of claim 1, wherein the hinge portion is slideable in a direction perpendicular to the longitudinal axis.

3. The lockable enclosure of claim 1, wherein the first latch portion includes a slot in the front lid wall, and the second latch portion includes a hasp extending from the fourth housing wall and received through the slot when the lid is in the latched position.

4. The lockable enclosure of claim 1, wherein the hinge portion comprises first and second pivot pins slideable in first and second side slots to permit sliding movement of the lid between the latched and unlatched positions.

5. The lockable enclosure of claim 4, wherein the first and second pivot pins are secured to the left and right side lid walls, and the first and second side slots are disposed in upper portions of the second and third side body walls.

6. The lockable enclosure of claim 1, wherein the first body flange includes a downward angled upper flange wall and an upward angled lower flange wall joined to form a V-shape in cross-section, wherein the first body lock aperture includes aligned first holes in the upper and lower flange walls.

7. The lockbox of claim 6, wherein the first lid flange is oriented for abutment with the upper flange wall of the first body flange when the lid is in the closed position.

8. The lockable enclosure of claim 1, further comprising a latch mechanism operable to latch the lid with the third side body wall when the lid is in the closed position.

9. The lockable enclosure of claim 8, wherein the latch mechanism comprises a hook member affixed to the third side body wall, and a buckle affixed to the lid, the buckle including a loop portion for engaging the hook portion to latch the lid with the third side body wall.

10. The lockable enclosure of claim 1, wherein when the lid is in the closed position, the hinge portion of the lid is slideable for sliding movement of the lid between a latching position in which a first latch portion of the lid engages a corresponding second latch portion of the lockbox body to secure the lid in the closed position, and a release position in which the first latch portion disengages from the second latch portion to permit pivoting movement of the lid from the closed position to the open position.

11. The lockable enclosure of claim 1, wherein the lid further comprises at least one locking feature configured to secure the closed lid in the latching position when the at least one locking feature is in a locked condition and to permit sliding movement of the closed lid to the release position when the at least one locking feature is in an unlocked condition.

12. The lockable enclosure of claim 10, wherein the first latch portion includes at least one longitudinally extending tab and the second latch portion includes at least one slot receiving a corresponding one of the at least one longitudinally extending tab when the lid is in the latching position.

13. A lockbox for secure storage of one or more items, the lockbox comprising:

a body including front, rear, and first and second side body walls each extending upward from a bottom body wall to an upper edge to define a storage enclosure therebetween; and a lid connected to the body and pivotable about first and second pivot pins between a closed position blocking access to the enclosure and an open position permitting access to the enclosure, the lid including front and first and second side lid walls extending downward from a top lid wall to a lower edge to overhang upper portions of the front and first and second side body walls when the lid is in the closed position;

wherein the first and second pivot pins are slideable in first and second side slots in the body, such that when the lid is in the closed position, the lid is slideable between a latched position in which the lid is secured against pivoting movement to the open position and an unlatched position in which the lid is permitted to pivot to the open position.

14. The lockbox of claim 13, wherein when the lid is in the latched position, a first lid lock aperture in the lid aligns with a first body lock aperture in the body, such that insertion of a padlock shackle through the first lid lock aperture and the first body lock aperture prevents sliding movement of the lid from the latched position to the unlatched position.

15. A lockable enclosure for secure storage of one or more items, the lockable enclosure comprising:

a housing including first, second, third, and fourth side walls each extending forward from a rear wall to a front end to define a storage cavity therebetween; and an access door having a hinge portion connected with the first side wall, the access door being pivotable about a longitudinal axis of the hinge portion between a closed position blocking access to the cavity and an open position permitting access to the cavity;

wherein when the access door is in the closed position, the access door is slideable along the longitudinal axis between an interlocking position in which a first interlock portion of the access door engages a corresponding second interlock portion of the first side wall to secure the access door in the closed position, and a release position in which the first interlock portion disengages from the second interlock portion to permit pivoting movement of the access door from the closed position to the open position;

wherein the access door further comprises at least one locking feature configured to secure the closed access door in the interlocking position when the at least one locking feature is in a locked condition and to permit sliding movement of the closed access door to the release position when the at least one locking feature is in an unlocked condition.

16. The lockable enclosure of claim 15, further comprising a spring biasing mechanism configured to automatically move the closed access door from the interlocking position to the release position when the at least one locking feature is in the unlocked condition.

17. The lockable enclosure of claim 16, wherein the spring biasing mechanism comprises a compression spring disposed between the access door hinge portion and a hinge portion of the housing.

18. The lockable enclosure of claim 17, wherein the housing hinge portion comprises a hinge pin extending through the compression spring and defining the longitudinal axis.

19. The lockable enclosure of claim 15, wherein the first interlock portion includes at least one longitudinally extending tab and the second interlock portion includes at least one slot receiving a corresponding one of the at least one longitudinally extending tab when the access door is in the interlocking position.

20. The lockable enclosure of claim 15, wherein the locking feature comprises at least one lockout aperture carried by the access door, wherein when the access door is in the closed and interlocking position, insertion of a padlock shackle through any of the at least one lockout aperture prevents sliding movement of the access door from the interlocking position to the release position.

* * * * *